US008435135B2

(12) United States Patent
Stites et al.

(10) Patent No.: US 8,435,135 B2
(45) Date of Patent: May 7, 2013

(54) GOLF CLUB HEAD OR OTHER BALL STRIKING DEVICE HAVING REMOVABLE OR INTERCHANGEABLE BODY MEMBER

(75) Inventors: John T. Stites, Weatherford, TX (US); Gary G. Tavares, Southbridge, MA (US); Robert Boyd, Euless, TX (US); David Anthony Chargin, Somerville, MA (US); Aaron Barrett Size, Waltham, MA (US); Mark J. Perry, Hilliard, OH (US); Timothy J. Lastrapes, Powell, OH (US); Robert E. Mora, Worthington, OH (US); J. David Robbins, Worthington, OH (US)

(73) Assignee: Nike, Inc., Beaverton, OR (US)

( * ) Notice: Subject to any disclaimer, the term of this patent is extended or adjusted under 35 U.S.C. 154(b) by 53 days.

(21) Appl. No.: 12/790,368

(22) Filed: May 28, 2010

(65) Prior Publication Data

US 2011/0294589 A1 Dec. 1, 2011

(51) Int. Cl.
*A63B 53/06* (2006.01)

(52) U.S. Cl.
USPC ..... 473/334; 473/345; 473/349

(58) Field of Classification Search ..... 473/288, 473/345–346, 333–337, 349
See application file for complete search history.

(56) References Cited

U.S. PATENT DOCUMENTS

| | | | | |
|---|---|---|---|---|
| 1,167,106 | A | 1/1916 | Palmer | |
| 1,319,233 | A * | 10/1919 | Mattern | 473/337 |
| 1,538,312 | A | 5/1925 | Beat | |
| 1,672,618 | A * | 6/1928 | Link | 473/343 |
| 1,840,924 | A | 1/1932 | Tucker | |
| 3,064,980 | A | 11/1962 | Steiner | |
| 3,170,698 | A | 2/1965 | Schoeffler et al. | |
| 3,220,733 | A | 11/1965 | Saleeby | |
| 3,637,218 | A | 1/1972 | Carlino | |
| 3,817,534 | A | 6/1974 | Carlino | |
| 3,966,210 | A | 6/1976 | Rozmus | |
| 3,979,123 | A | 9/1976 | Belmont | |

(Continued)

FOREIGN PATENT DOCUMENTS

| | | |
|---|---|---|
| CN | 201067612 | 6/2008 |
| EP | 1752198 | 2/2007 |

(Continued)

OTHER PUBLICATIONS

International Search Report & Written Opinion from PCT Application No. PCT/US2011/035329, mailed Jul. 7, 2011.

(Continued)

*Primary Examiner* — Stephen L. Blau
(74) *Attorney, Agent, or Firm* — Banner & Witcoff, Ltd.

(57) ABSTRACT

A ball striking device, such as a golf club, includes a head with a face having a ball striking surface configured for striking a ball, a main body member connected to the face and having an engagement surface located in the rear side, a removable body member removably connected to the main body member, and a connecting element removably connecting the removable body member to the main body member. The connecting element includes a moveable engaging member that is moveable between a locked position, where the engaging member engages the engagement surface to retain the removable body member to the main body member, and an unlocked position, where the engaging member does not engage the engagement surface and the removable body member is removable from the main body member.

20 Claims, 17 Drawing Sheets

U.S. PATENT DOCUMENTS

| | | | | |
|---|---|---|---|---|
| 4,291,883 | A | 9/1981 | Smart et al. | |
| 4,811,949 | A | 3/1989 | Kobayashi | |
| 4,811,950 | A * | 3/1989 | Kobayashi | 473/335 |
| 4,883,274 | A | 11/1989 | Hsien | |
| 5,230,509 | A | 7/1993 | Chavez | |
| 5,421,577 | A | 6/1995 | Kobayashi | |
| 5,437,447 | A * | 8/1995 | Rigutto | 473/251 |
| 5,518,243 | A | 5/1996 | Redman | |
| 5,584,770 | A | 12/1996 | Jensen | |
| 5,720,674 | A | 2/1998 | Galy | |
| 5,971,867 | A | 10/1999 | Galy | |
| 6,030,293 | A | 2/2000 | Takeda | |
| 6,217,461 | B1 | 4/2001 | Galy | |
| 6,290,608 | B2 | 9/2001 | Gates | |
| 6,440,009 | B1 | 8/2002 | Giubaud et al. | |
| 6,458,044 | B1 | 10/2002 | Vincent et al. | |
| 6,623,378 | B2 * | 9/2003 | Beach et al. | 473/345 |
| 6,641,487 | B1 | 11/2003 | Hamburger | |
| 6,648,772 | B2 | 11/2003 | Vincent et al. | |
| 6,739,983 | B2 | 5/2004 | Helmstetter et al. | |
| D502,235 | S | 2/2005 | Burrows | |
| 6,860,818 | B2 | 3/2005 | Mahaffey et al. | |
| 6,890,267 | B2 | 5/2005 | Mahaffey et al. | |
| 6,988,960 | B2 * | 1/2006 | Mahaffey et al. | 473/345 |
| 7,083,530 | B2 | 8/2006 | Wahl et al. | |
| 7,101,290 | B2 * | 9/2006 | Tucker, Sr. | 473/340 |
| 7,108,611 | B2 | 9/2006 | MacIlraith | |
| 7,147,573 | B2 | 12/2006 | DiMarco | |
| 7,153,220 | B2 | 12/2006 | Lo | |
| 7,163,468 | B2 | 1/2007 | Gibbs et al. | |
| 7,163,470 | B2 | 1/2007 | Galloway et al. | |
| 7,166,041 | B2 | 1/2007 | Evans | |
| 7,396,299 | B2 | 7/2008 | Nicolette et al. | |
| 7,549,935 | B2 | 6/2009 | Foster et al. | |
| 7,628,711 | B2 * | 12/2009 | Akinori et al. | 473/335 |
| 7,632,193 | B2 * | 12/2009 | Thielen | 473/334 |
| 7,637,822 | B2 | 12/2009 | Foster et al. | |
| 7,713,143 | B2 | 5/2010 | Evans | |
| 2003/0054900 | A1 | 3/2003 | Tindale | |
| 2003/0134690 | A1 * | 7/2003 | Chen | 473/345 |
| 2004/0132541 | A1 * | 7/2004 | MacIlraith | 473/334 |
| 2004/0185960 | A1 * | 9/2004 | Chen | 473/342 |
| 2005/0137024 | A1 | 6/2005 | Stites et al. | |
| 2007/0037633 | A1 * | 2/2007 | Thielen | 473/346 |
| 2007/0225085 | A1 | 9/2007 | Koide et al. | |
| 2008/0146370 | A1 | 6/2008 | Beach et al. | |
| 2008/0171610 | A1 | 7/2008 | Shin | |
| 2009/0186717 | A1 | 7/2009 | Stites et al. | |
| 2009/0270199 | A1 * | 10/2009 | Chen | 473/348 |
| 2010/0041495 | A1 * | 2/2010 | North et al. | 473/346 |
| 2010/0160091 | A1 * | 6/2010 | Boyd et al. | 473/409 |
| 2010/0184532 | A1 | 7/2010 | Boyd et al. | |
| 2010/0190573 | A1 | 7/2010 | Boyd | |

FOREIGN PATENT DOCUMENTS

| | | | |
|---|---|---|---|
| GB | 2422554 | | 8/2006 |
| JP | 2084972 | | 3/1990 |
| JP | 5049715 | | 3/1993 |
| JP | 7231957 | | 9/1995 |
| JP | 11-178955 | * | 7/1999 |
| JP | 11244433 | | 9/1999 |
| JP | 200014841 | | 1/2000 |
| JP | 2001000606 | | 1/2001 |
| JP | 2001025518 | | 1/2001 |
| JP | 2001062013 | | 3/2001 |
| JP | 2001321474 | | 11/2001 |
| JP | 2003062133 | | 3/2003 |
| JP | 2003169870 | | 6/2003 |
| JP | 2004081241 | | 3/2004 |
| JP | 2004337608 | | 12/2004 |
| JP | 2006239154 | | 9/2006 |
| JP | 2006288882 | | 10/2006 |
| JP | 20007083012 | | 4/2007 |
| JP | 2008-79627 | * | 4/2008 |
| WO | 2005035073 | | 4/2005 |
| WO | 2005058427 | | 6/2005 |
| WO | 2005079933 | | 9/2005 |
| WO | 2010019636 | | 2/2010 |
| WO | 2010028114 | | 3/2011 |

OTHER PUBLICATIONS

International Search Report and Written Opinion issued Jul. 7, 2010 in PCT Application No. PCT/US2010/021355.

* cited by examiner

GOLF CLUB HEAD OR OTHER BALL STRIKING DEVICE HAVING REMOVABLE OR INTERCHANGEABLE BODY MEMBER

TECHNICAL FIELD

The invention relates generally to ball striking devices, such as golf club heads, having a removable and/or interchangeable body member forming at least a portion of a body of the head. Certain aspects of this invention relate to golf club heads having a removable and/or interchangeable body member connected to the head by a moveable connecting element.

BACKGROUND

Golf is enjoyed by a wide variety of players—players of different genders, and players of dramatically different ages and skill levels. Golf is somewhat unique in the sporting world in that such diverse collections of players can play together in golf outings or events, even in direct competition with one another (e.g., using handicapped scoring, different tee boxes, etc.), and still enjoy the golf outing or competition. These factors, together with increased golf programming on television (e.g., golf tournaments, golf news, golf history, and/or other golf programming) and the rise of well known golf superstars, at least in part, have increased golfs popularity in recent years, both in the United States and across the world.

Golfers at all skill levels seek to improve their performance, lower their golf scores, and reach that next performance "level." Manufacturers of all types of golf equipment have responded to these demands, and recent years have seen dramatic changes and improvements in golf equipment. For example, a wide range of different golf ball models now are available, with some balls designed to fly farther and straighter, provide higher or flatter trajectory, provide more spin, control, and feel (particularly around the greens), etc.

Being the sole instrument that sets a golf ball in motion during play, the golf club also has been the subject of much technological research and advancement in recent years. For example, the market has seen improvements in golf club heads, shafts, and grips in recent years. Additionally, other technological advancements have been made in an effort to better match the various elements of the golf club and characteristics of a golf ball to a particular user's swing features or characteristics (e.g., club fitting technology, ball launch angle measurement technology, etc.).

Despite the various technological improvements, golf remains a difficult game to play at a high level. For a golf ball to reliably fly straight and in the desired direction, a golf club must meet the golf ball square (or substantially square) to the desired target path. Moreover, the golf club must meet the golf ball at or close to a desired location on the club head face (i.e., on or near a "desired" or "optimal" ball contact location) to reliably fly straight, in the desired direction, and for a desired distance. Off-center hits may tend to "twist" the club face when it contacts the ball, thereby sending the ball in the wrong direction, imparting undesired hook or slice spin, and/or robbing the shot of distance. Club face/ball contact that deviates from squared contact and/or is located away from the club's desired ball contact location, even by a relatively minor amount, also can launch the golf ball in the wrong direction, often with undesired hook or slice spin, and/or can rob the shot of distance. Accordingly, club head features that can help a user keep the club face square with the ball would tend to help the ball fly straighter and truer, in the desired direction, and often with improved and/or reliable distance.

Various golf club heads have been designed to improve a golfer's accuracy by assisting the golfer in squaring the club head face at impact with a golf ball. A number of golf club heads reposition the weight of the golf club head in order to alter the location of the club head's center of gravity. The location of the center of gravity of the golf club head is one factor that determines whether a golf ball is propelled in the intended direction. When the center of gravity is positioned behind the point of engagement on the contact surface, the golf ball follows a generally straight route. When the center of gravity is spaced to a side of the point of engagement, however, the golf ball may fly in an unintended direction and/or may follow a route that curves left or right, ball flights that are often referred to as "pulls," "pushes," "draws," "fades," "hooks," or "slices". Similarly, when the center of gravity is spaced above or below the point of engagement, the route of the golf ball may exhibit more boring or climbing trajectories, respectively. In some circumstances, it may be desirable to raise or lower the center of gravity of a club head in order to achieve these and other ball flight characteristics.

The degree of twisting of the club head upon off-center impacts can also be dependent upon the moment of inertia of the club head. Generally, a higher moment of inertia results in less twisting of the club head on impact. The moment of inertia can be increased by distributing the weight of the club head proportionally more toward the edges of the head and away from the center or location of contact.

Many off-center golf hits are caused by common errors in swinging the golf club that are committed repeatedly by the golfer, and which may be similarly committed by many other golfers. As a result, patterns can often be detected, where a large percentage of off-center hits occur in certain areas of the club face. For example, one such pattern that has been detected is that many high handicap golfers tend to hit the ball on the low-heel area of the club face and/or on the high-toe area of the club face. Other golfers may tend to miss in other areas of the club face. Because golf clubs are typically designed to contact the ball at or around the center of the face, such off-center hits may result in less energy being transferred to the ball, decreasing the distance of the shot. The energy or velocity transferred to the ball by a golf club can be expressed using a measurement called "coefficient of restitution" (or "COR"). The maximum COR for golf club heads is currently limited by the USGA at 0.83. As described above, the direction of ball flight and the degree of twisting of the club head during impact may also be related, at least in part, to the moment of inertia of the club head and the location of the center of gravity of the club head with relation to the point of impact. The energy or velocity transferred to the ball by the golf club may also be related to the moment of inertia and/or the location of the center of gravity of the club head.

The distance and direction of ball flight can also be significantly affected by the spin imparted to the ball by the impact with the club head. While the ball is in the air, aerodynamic forces caused by the speed and direction of ball spin can cause the trajectory of the ball to be higher or lower, or to curve, and create "draws," "fades," "hooks," "slices," etc. Additionally, the spin of the ball can change the behavior of the ball as it rolls and bounces after impact with the ground. For example, a high degree of backspin can cause the ball to slow, stop, or even roll backward upon impact, and conversely, topspin or lesser degrees of backspin will cause the ball to travel a greater distance after impact with the ground. Various speeds and directions of spin on the ball can be a product of many factors, including the point of impact, the direction of the club head upon impact, the degree of twisting of the club head upon impact, and the location of the center of gravity of the club head.

Accordingly, a need exists to customize or adjust the moment of inertia and/or the location of the center of gravity of a golf club head to provide maximum energy transfer and minimum twisting during impacts on the face, as well as to provide desired ball flight characteristics after impact.

BRIEF SUMMARY

The following presents a general summary of aspects of the invention in order to provide a basic understanding of the invention. This summary is not an extensive overview of the invention. It is not intended to identify key or critical elements of the invention or to delineate the scope of the invention. The following summary merely presents some concepts of the invention in a general form as a prelude to the more detailed description provided below.

Aspects of the invention relate to ball striking devices, such as golf clubs, with a head that includes a face configured for striking a ball and a body connected to the face, the body being adapted for connection of a shaft thereto. Various example structures of heads described herein include a face having a ball striking surface configured for striking a ball, a main body member connected to the face and having a rear side opposite the face and an engagement surface located in the rear side, a removable body member removably connected to the main body member, and a connecting element removably connecting the removable body member to the main body member. The connecting element includes a moveable engaging member that is moveable between a locked position, where the engaging member engages the engagement surface to retain the removable body member to the main body member, and an unlocked position, where the engaging member does not engage the engagement surface and the removable body member is removable from the main body member.

According to one aspect, the connecting element includes a pin rotatably mounted to the removable body member, with the engaging member connected to the pin, and the connecting element is moveable by rotation of the pin between the locked position and the unlocked position. In one embodiment, the pin has an axis of rotation extending generally perpendicular to the ball striking surface and/or extending from a rear of the head toward the face.

According to another aspect, the main body member has a plurality of notches located on the rear side, and the removable body member has a plurality of projections, each projection being received in a corresponding one of the notches to cooperate with the connecting element to retain the removable body member to the main body member.

According to another aspect, each of the notches is an elongated channel extending generally in a direction from a front of the head to a rear of the head, and each of the projections is an elongated ridge cooperatively dimensioned to be received within a corresponding one of the elongated channels. In one embodiment, the engaging member engages the engagement surface to exert a horizontal retaining force on the removable body member and the ridges engage the channels to exert a vertical retaining force and a lateral retaining force on the removable body member to retain the removable body member to the main body member.

According to another aspect, the engaging member engages the engagement surface to exert a vertical retaining force on the removable body member and the projections engage the notches to exert a horizontal retaining force and a lateral retaining force on the removable body member to retain the removable body member to the main body member. In one embodiment, the projections include a pair of hinge projections forming a hinge point, such that the removable body member is connected to the removable body member in a hinged manner.

According to a further aspect, the engaging member is formed by a plate extending radially from an axis of rotation of the pin. In one embodiment, the plate has a protrusion thereon, and the main body member has a detent that receives the protrusion in the locked position. In another embodiment, the main body member further comprises a slot, with the engagement surface defined within the slot, and at least a portion of the plate is received within the slot to engage the engagement surface in the locked position.

According to another aspect, the engaging member is formed by a semicircular flange extending axially from an end of the pin, the flange extending around a portion of a circumference of the pin. In one embodiment, the main body member further includes a peg, with the engagement surface defined on a side surface of the peg, and the flange is rotated to engage the peg in the locked position.

According to a still further aspect, at least one of the engagement surface and the engaging member has a ramp portion. When the engagement surface has a ramp portion, the engaging member engages the ramp portion and slides across the ramp portion as the engaging member moves from the unlocked position to the locked position. When the engaging member has a ramp portion, the engagement surface engages the ramp portion and slides across the ramp portion as the engaging member moves from the unlocked position to the locked position.

According to yet another aspect, the main body member includes a recessed perimeter area, and the removable body member has a perimeter flange extending around at least a portion of an outer periphery of the removable body member. The perimeter flange sits within the recessed perimeter area and forms a lap joint with the recessed perimeter area to secure or seal the main body member and the removable body member together.

Additional aspects of the invention relate to removable body members configured for attachment to a golf club head that includes a face and a main body member connected to the face. The removable body member includes a frame member having a mating portion configured for mating engagement with a rear portion of the main body member of the golf club head and a connecting element adapted for removably connecting the frame member to the main body member of the golf club head. The connecting element includes a pin rotatably mounted to the frame member and an engaging member connected to the pin. The connecting element is moveable by rotation of the pin between a locked position, where the engaging member is adapted to engage an engagement surface on the main body member to retain the removable body member to the main body member, and an unlocked position, where the engaging member is adapted to not engage the engagement surface and the removable body member is adapted to be removable from the main body member.

According to one aspect, the mating portion of the frame member includes a plurality of projections adapted to be received within a plurality of notches in the main body member of the golf club head to form the mating engagement between the frame member and the main body member.

Further aspects of the invention relate to a golf club kit that includes a golf club head with a face and a main body member as described above, and two or more removable body members that are removably connectable to the main body member. Each removable body member includes a connection element that is moveable between a locked position and an unlocked position, as described above. The removable body members are alternately connectable to the golf club head. Additionally, the removable body members are different from each other, such as having at least one of a different external shape and a different weight distribution.

Still further aspects of the invention relate to methods in which a golf club head as described above is provided, including a face, a main body member connected to the face, and a removable body member as described above connected to the main body member. The removable body member is removed from the main body member, including moving the connecting element of the removable body member to the unlocked position. Then, a second removable body member, as described above, is connected to the main body member, including moving the connecting element of the second removable body member to the locked position. The second removable body member has at least one of a different external shape and a different weight distribution from the original removable body member.

Other aspects of the invention relate to golf clubs that includes heads as described above and shafts connected to the heads.

Other features and advantages of the invention will be apparent from the following description taken in conjunction with the attached drawings.

BRIEF DESCRIPTION OF THE DRAWINGS

To allow for a more full understanding of the present invention, it will now be described by way of example, with reference to the accompanying drawings in which.

DETAILED DESCRIPTION

Figure 1:
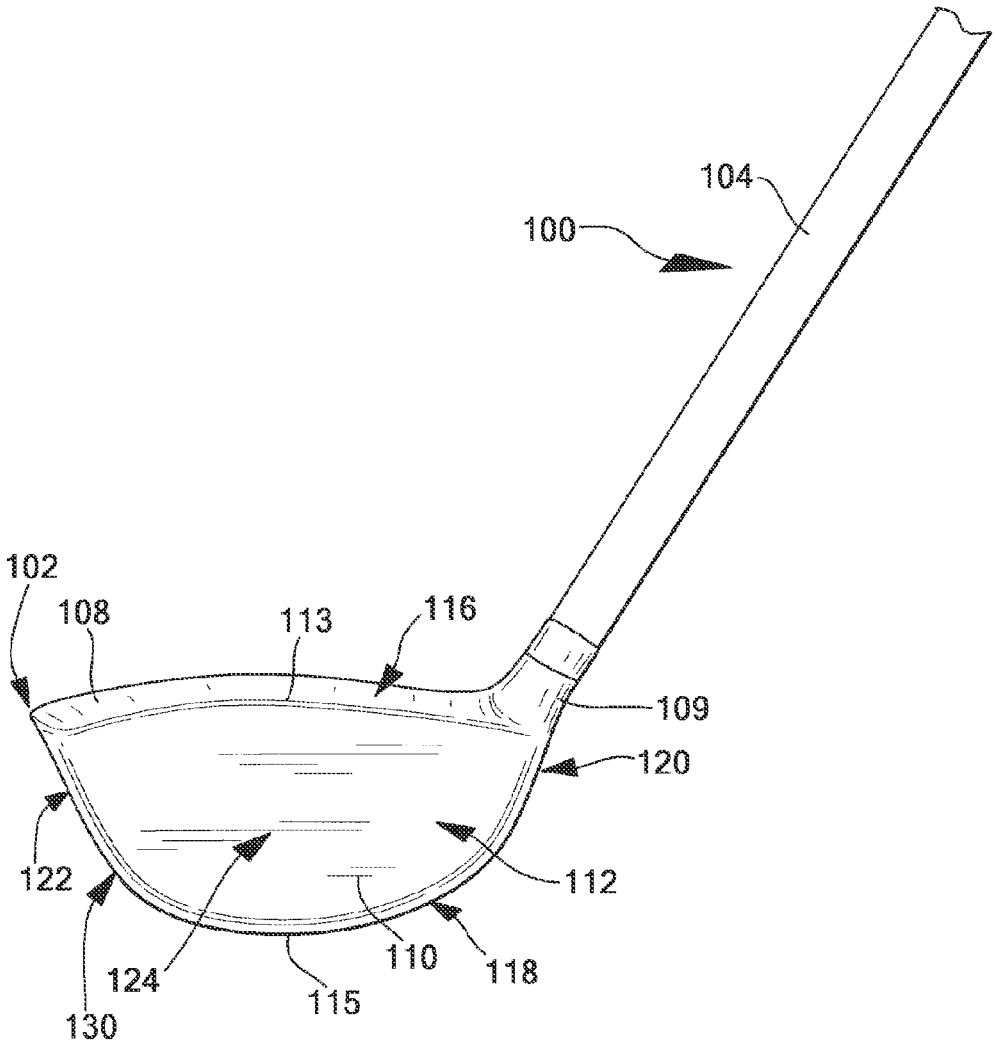
FIG. 1 is a front view of an illustrative embodiment of a head of a ball striking device according to the present invention.

In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention. Also, while the terms "top," "bottom," "front," "back," "side," "rear," and the like may be used in this specification to describe various example features and elements of the invention, these terms are used herein as a matter of convenience, e.g., based on the example orientations shown in the figures or the orientation during typical use. Additionally, the term "plurality," as used herein, indicates any number greater than one, either disjunctively or conjunctively, as necessary, up to an infinite number. Nothing in this specification should be construed as requiring a specific three dimensional orientation of structures in order to fall within the scope of this invention. Also, the reader is advised that the attached drawings are not necessarily drawn to scale.

The following terms are used in this specification, and unless otherwise noted or clear from the context, these terms have the meanings provided below.

"Ball striking device" means any device constructed and designed to strike a ball or other similar objects (such as a hockey puck). In addition to generically encompassing "ball striking heads," which are described in more detail below, examples of "ball striking devices" include, but are not limited to: golf clubs, putters, croquet mallets, polo mallets, baseball or softball bats, cricket bats, tennis rackets, badminton rackets, field hockey sticks, ice hockey sticks, and the like.

"Ball striking head" means the portion of a "ball striking device" that includes and is located immediately adjacent (optionally surrounding) the portion of the ball striking device designed to contact the ball (or other object) in use. In some examples, such as many golf clubs and putters, the ball striking head may be a separate and independent entity from any shaft or handle member, and it may be attached to the shaft or handle in some manner.

The terms "shaft" and "handle" are used synonymously and interchangeably in this specification, and they include the portion of a ball striking device (if any) that the user holds during a swing of a ball striking device.

"Integral joining technique" means a technique for joining two pieces so that the two pieces effectively become a single, integral piece, including, but not limited to, irreversible joining techniques, such as adhesively joining, cementing, welding, brazing, soldering, or the like, where separation of the joined pieces cannot be accomplished without structural damage thereto.

In general, aspects of this invention relate to ball striking devices, such as golf club heads, golf clubs, putter heads, putters, and the like. Such ball striking devices, according to at least some examples of the invention, may include a ball striking head and a ball striking surface. In the case of a golf club, the ball striking surface is a substantially flat surface on one face of the ball striking head (taking into consideration that the ball striking face of some golf club heads may include some bulge and/or roll characteristics, as described herein). Some more specific aspects of this invention relate to wood-type golf clubs and golf club heads, including drivers, fairway woods, wood-type hybrid clubs, and the like, although aspects of this invention also may be practiced on irons, iron-type hybrid clubs, and the like.

According to various aspects of this invention, the ball striking device may be formed of one or more of a variety of materials, such as metals (including metal alloys), ceramics, polymers, composites (including fiber-reinforced composites), and wood, and may be formed in one of a variety of configurations, without departing from the scope of the invention. In one illustrative embodiment, some or all components of the head, including the face and at least a portion of the body of the head, are made of metal. It is understood that the head may contain components made of several different materials, including carbon-fiber and other components. Additionally, the components may be formed by various forming methods. For example, metal components (such as titanium, aluminum, titanium alloys, aluminum alloys, steels (including stainless steels), and the like) may be formed by forging, molding, casting, stamping, machining, and/or other known techniques. In another example, composite components, such as carbon fiber-polymer composites, can be manufactured by a variety of composite processing techniques, such as prepreg processing, powder-based techniques, mold infiltration, and/or other known techniques.

The various figures in this application illustrate examples of ball striking devices according to this invention. When the same reference number appears in more than one drawing, that reference number is used consistently in this specification and the drawings to refer to the same or similar parts throughout.

At least some examples of ball striking devices according to this invention relate to golf club head structures, including heads for wood-type golf clubs, such as drivers, as well as long iron clubs (e.g., driving irons, zero irons through five irons, and hybrid type golf clubs), short iron clubs (e.g., six irons through pitching wedges, as well as sand wedges, lob wedges, gap wedges, and/or other wedges), and putters. Such devices may include a one-piece construction or a multiple-piece construction. Example structures of ball striking devices according to this invention will be described in detail below in conjunction with FIG. 1, which illustrates an example of a ball striking device 100 in the form of a golf driver.

Figure 2:
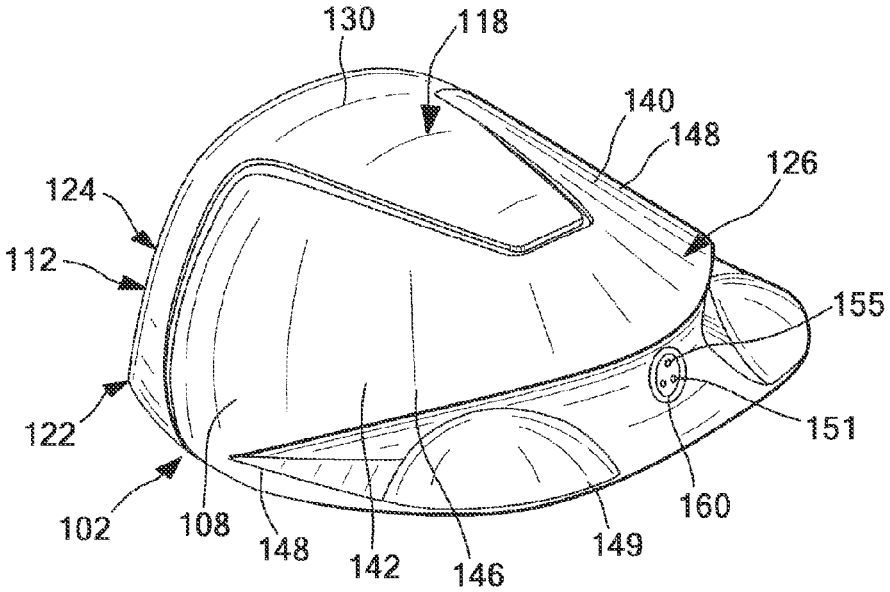
FIG. 2 is a bottom rear perspective view of the head of FIG. 1.

FIGS. 1-7 illustrate a ball striking device 100 in the form of a golf driver, in accordance with at least some examples of this invention. As shown in FIG. 1, the ball striking device 100 includes a ball striking head 102 and a shaft 104 connected to the ball striking head 102 and extending therefrom. The ball striking head 102 of the ball striking device 100 of FIG. 1 has a face 112 connected to a body 108, with a hosel 109 extending therefrom. Any desired hosel and/or head/shaft interconnection structure may be used without departing from this invention, including conventional hosel and/or head/shaft interconnection structures as are known and used in the art. For reference, the head 102 generally has a top 116, a bottom or sole 118, a heel 120 proximate the hosel 109, a toe 122 distal from the hosel 109, a front 124, and a back or rear 126, as shown in FIGS. 1-2. The shape and design of the head 102 may be partially dictated by the intended use of the device 100. In the club 100 shown in FIG. 1, the head 102 has a relatively large volume, as the club 100 is designed for use as a driver or wood-type club, intended to hit the ball accurately over long distances. In other applications, such as for a different type of golf club, the head may be designed to have different dimensions and configurations. When configured as a driver, the club head may have a volume of at least 400 cc, and in some structures, at least 450 cc, or even at least 460 cc. Other appropriate sizes for other club heads may be readily determined by those skilled in the art. It is understood that in some embodiments, the face 112 and the body 108 may be part of a unitary structure, such as in a head 102 that has no inner cavity. In such an embodiment, the ball striking surface 110 and the rear surface 111 of the face 112 may be surfaces formed on the body 108 of the club head 102.

In the example embodiment illustrated in FIGS. 1-7, the head 102 has a hollow structure defining an inner cavity 101 (e.g., defined by the face 112 and the body 108). Thus, the head 102 has a plurality of inner surfaces defined therein. In one embodiment, the hollow center cavity 101 may be filled with air. However, in other embodiments, the head 102 could be filled with another material, such as foam. In still further embodiments, the solid materials of the head may occupy a greater proportion of the volume, and the head may have a smaller cavity or no inner cavity at all. It is understood that the inner cavity may not be completely enclosed in some embodiments.

The face 112 is located at the front 124 of the head 102, and has a ball striking surface 110 located thereon and a rear or inner surface 111 opposite the ball striking surface 110. The ball striking surface 110 is typically an outer surface of the face 112 configured to face a ball (not shown) in use, and is adapted to strike the ball when the device 100 is set in motion, such as by swinging. As shown, the ball striking surface 110 is relatively flat, occupying most of the face 112. For reference purposes, the portion of the face 112 nearest the top face edge 113 and the heel 120 of the head 102 is referred to as the "high-heel area"; the portion of the face 112 nearest the top face edge 113 and toe 122 of the head 102 is referred to as the "high-toe area"; the portion of the face 112 nearest the bottom face edge 115 and heel 120 of the head 102 is referred to as the "low-heel area"; and the portion of the face 112 nearest the bottom face edge 115 and toe 122 of the head 102 is referred to as the "low-toe area". Conceptually, these areas may be recognized and referred to as quadrants of substantially equal size (and/or quadrants extending from a geometric center of the face 112), though not necessarily with symmetrical dimensions. The face 112 may include some curvature in the top to bottom and/or heel to toe directions (e.g., bulge and roll characteristics), as is known and is conventional in the art. In other embodiments, the surface 110 may occupy a different proportion of the face 112, or the body 108 may have multiple ball striking surfaces 110 thereon. In the illustrative embodiment shown in FIG. 1, the ball striking surface 110 is inclined slightly (i.e., at a loft angle), to give the ball slight lift and spin when struck. In other illustrative embodiments, the ball striking surface 110 may have a different incline or loft angle, to affect the trajectory of the ball. Additionally, the face 112 may have a variable thickness and/or may have one or more internal or external inserts in some embodiments.

The ball striking device 100 may include a shaft 104 connected to or otherwise engaged with the ball striking head 102 as shown schematically in FIG. 1. The shaft 104 is adapted to be gripped by a user to swing the ball striking device 100 to strike the ball (not shown). The shaft 104 can be formed as a separate piece connected to the head 102, such as by connecting to the hosel 109, as shown in FIG. 1. In other illustrative embodiments, at least a portion of the shaft 104 may be an integral piece with the head 102, and/or the head 102, may not contain a hosel 109 or may contain an internal hosel structure. Still further embodiments are contemplated without departing from the scope of the invention. The shaft 104 may be constructed from one or more of a variety of materials, including metals, ceramics, polymers, composites, or wood. In some illustrative embodiments, the shaft 104, or at least portions thereof, may be constructed of a metal, such as stainless steel or titanium, or a composite, such as a carbon/graphite fiber-polymer composite. However, it is contemplated that the shaft 104 may be constructed of different materials without departing from the scope of the invention, including conventional materials that are known and used in the art. A grip element (not shown) may be positioned on the shaft 104 to provide a golfer with a slip resistant surface with which to grasp golf club shaft 104, as known in the art. The grip element may be attached to the shaft 104 in any desired manner, including in conventional manners known and used in the art (e.g., via adhesives or cements, threads or other mechanical connectors, swedging/swaging, etc.).

In various embodiments described herein, the body 108 of the ball striking head 102 is formed of a main body member 130 and at least one secondary or removable body member 140 removably connected to the main body member 130. The main body member 130 is connected to the face 112 and extends rearward from the face 112 to form at least a portion of the body 108 of the head 102. In the embodiment shown in FIGS. 1-7, the removable body member 140 includes a movable connecting element 160 that connects the removable body member 140 to the main body member 130, as described in more detail below. As also described below, in the embodiment shown in FIGS. 1-7, the removable body member 140 and the main body member 130 have complementary connecting structures, which further secure the connection between the removable body member 140 and the main body member 130. Further, in this embodiment, the removable body member 140 is attached to the back or rear end 127 of the main body member 130, covering at least a portion of the back end 127 and forming a portion of the rear 126 of the club head 102. However, in other embodiments, the removable body member 140 may be configured differently, as further described below.

In the embodiment shown in FIGS. 1-7, the face 112 and the main body member 130 are fixedly and/or permanently connected to form a single piece. It is understood that the face 112, the main body member 130, and/or the hosel 109 can be formed as a single piece or as separate pieces that are joined together, such as by an integral joining method. In one illustrative embodiment, not shown in the drawings, the face 112 is formed as part of a face frame member, with a wall or walls extending rearward from the edges of the face 112. This configuration is also known as a "cup face" structure. The main body member 130 can be formed as a separate piece or pieces joined to the wall(s) of the face frame member, such as by a backbody member attached to the cup face structure, composed of a single piece or multiple pieces. These pieces may be connected by an integral joining technique, such as welding, cementing, or adhesively joining Other known techniques for joining these parts can be used as well, including many mechanical joining techniques, including releasable mechanical engagement techniques. Further, a gasket (not shown) may be included between the cup face structure and the backbody member. When assembled as shown in FIGS. 1-2, the removable body member 140, the face 112, and the main body member 130, all combine to form an enclosed volume, which in one embodiment, is at least 400 cc, and in some structures, at least 450 cc, or even at least 460 cc, as described above. It is understood that the enclosed volume of the head may be changed by interchanging different removable body members 140 on the main body member 130.

Figure 3:
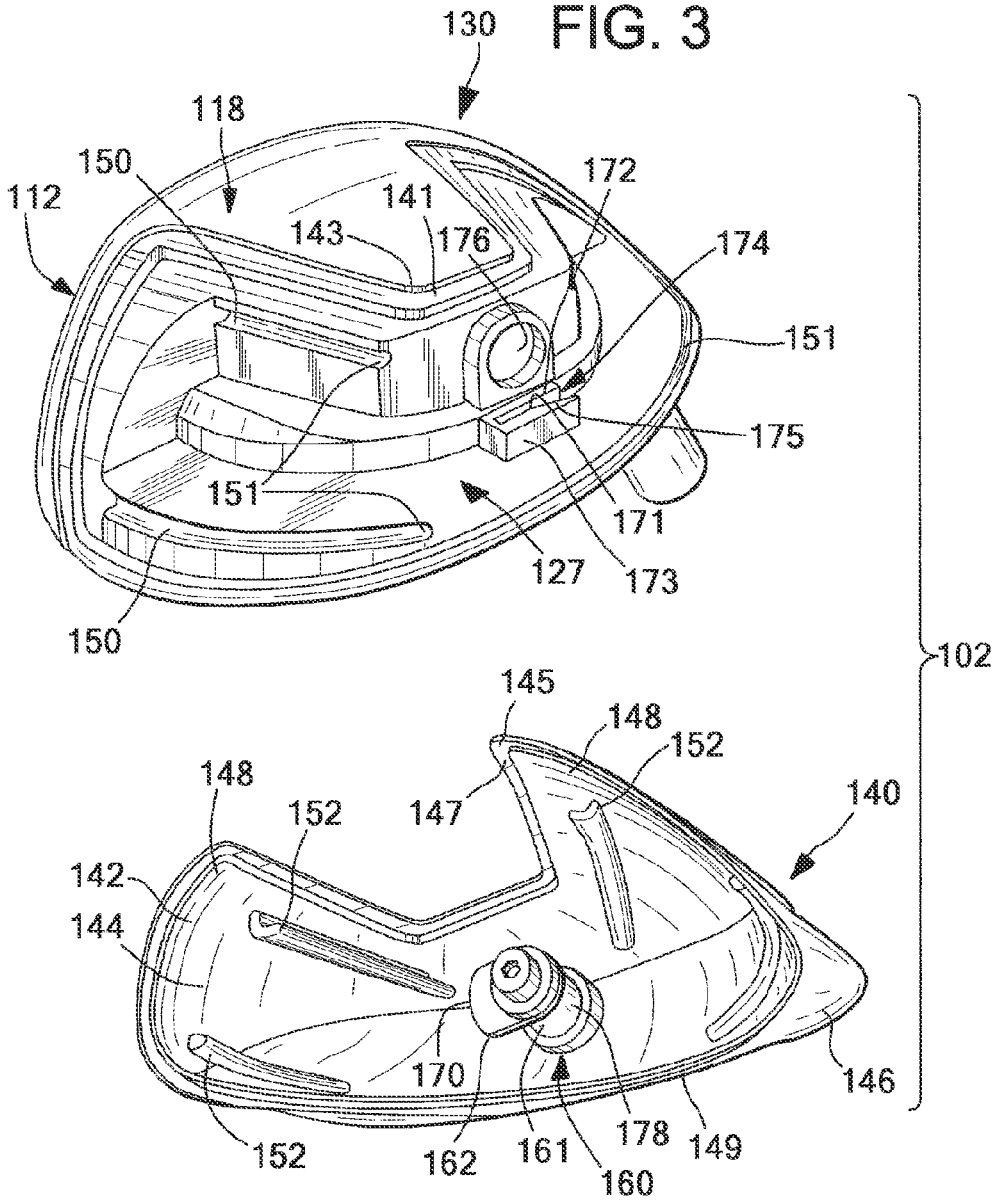
FIG. 3 is an exploded rear view of the head of FIG. 1, with a removable body member removed from the head to show internal detail.

In the embodiment shown in FIGS. 1-7, the removable body member 140 includes a frame member 142 and a connecting element 160 connected to the frame member 142. The connecting element 160 is movable to connect and disconnect the removable body member 140 to and from the main body member 130, as described below. The frame member 142 is complementarily shaped with the back end 127 of the main body member 130 to facilitate the connection between the removable body member 140 and the main body member 130. For example, as shown in FIG. 3, the back end 127 of the main body member 130 is generally convex, and the frame member 142 has a concave configuration, with a generally concave inner surface 144 and a generally convex outer surface 146 to fit around the back end 127 of the main body member 130. In this embodiment, the frame member 142 may also be regarded as being generally U-shaped, having two opposed arms 148 and a bridge member 149 extending between the arms 148.

The complementary shape of the frame member 142 and the main body member 130 may also include complementary mating portions with interlocking structures to further secure the removable body member 140 to the main body member 130, such as one or more interlocking projections and notches. In the embodiment shown in FIGS. 3-5, the back end 127 of the main body member 130 has a mating portion that includes a plurality of notches 150 on the outer surface in the form of four elongated channels 150 extending from the front 124 to the rear 126 of the head 102. Additionally, the frame member 142 has a complementary mating portion that includes a plurality of projections 152 on the inner surface 144 that interlock with the channels 150, in the form of four elongated ridges 152 that are cooperatively dimensioned to be received within the corresponding channels 150. In this embodiment, each of the channels 150 has an open end 151 proximate the rear 126 of the head 102. The removable body member 140 can be connected to the main body member 130 by sliding the ridges 152 into the open ends 151 of the corresponding channels 150 and sliding the removable body member 140 generally in the direction of the channels 150 toward the front 124 of the head 102, such as shown schematically in FIG. 8. The interlocking of the ridges 152 and the channels 150 in this embodiment is shown, for example, in FIGS. 4-5. Once connected, the ridges 152 engage the channels 150 to exert a vertical retaining force component (i.e. between the top 116 and the sole 118) and a lateral retaining force component (i.e. between the heel 120 and the toe 122) on the removable body member 140 to securely retain the removable body member 140 to the main body member 130. As described below, the connecting element 160 exerts a horizontal retaining force component (i.e. between the front 124 and the rear 126) on the removable body member 140 to retain the removable body member 140 to the main body member 130 in this embodiment. In other embodiments, the main body member 130 and the removable body member 140 may have different complementary connecting structure, including a different configuration of notches and projections, such as that described below and shown in FIGS. 20-22. For example, in one embodiment, at least some of the mating or complementary connecting structures of the main body member 130 and the removable body member 140 may be transposed with respect to the configuration in FIGS. 3-5. In other words, the main body member 130 may contain projections that are received in notches in the removable body member 140, or each member 130, 140 may contain a mixture of complementary projections and notches. As another example, in one embodiment, the main body member 130 and the removable body member 140 may have a different type of complementary connecting structure other than projections and notches. In a further embodiment, the face 112 may have connecting structure to connect the removable body member 140 to the main body member 130.

The complementary shape of the frame member 142 and the main body member 130 may further include overlapping structures located around the edges of the frame member 142 to assist in sealing or otherwise securing the frame member 142 and the main body member 130 together. As shown in FIGS. 2-7, the main body portion 130 has a recessed perimeter portion 141 defined by a perimeter stepped portion 143, and the frame member 142 has a complementarily-shaped perimeter flange 145 extending around the edge of the frame member 142. The perimeter flange 145 in this embodiment has a thickness that is smaller than a thickness of an immediately adjacent portion of the removable body member 140 from which the perimeter flange 145 extends, forming a stepped configuration. When the removable body member 140 is connected to the main body member 130, the flange 145 sits within the recessed portion 141, such that the edge of the flange 145 confronts the stepped portion 143 and the lower surface 147 of the flange 145 engages the perimeter portion in surface-to-surface contact, forming a lap joint configuration. This engagement provides sealing around the perimeter of the removable body member 140 to ensure that moisture, debris, etc., do not seep in between the removable body member 140 and the main body member 130. Additionally, the flange 145 and the recessed portion 141 may be designed with a degree of tolerance, to accommodate frame members 142 and main body members 130 of slightly differing dimensions. In the embodiment shown in FIGS. 6-7, a space S exists between the edge of the flange 145 and the stepped portion 143, which, in combination with the surface-to-surface engagement of the flange 145 and the recessed portion 141, enable effective sealing over a larger degree of tolerance in the components. In another embodiment, the flange 145, the stepped portion 143, and/or the recessed portion 141 may include additional sealing components such as a gasket (not shown) or other seal-enhancing material.

Generally, the head 102 includes a connecting element 160 connecting the removable body member 140 to the main body member 130. The connecting element 160 has an engaging member 170 that is configured to engage an engagement surface 171 on the main body member 130 to connect the removable body member 140 to the main body member 130. In one embodiment, the engaging member 170 is moveable between at least a locked position (FIG. 6), where the engaging member engages the engagement surface 171 of the main body member 130 to retain the removable body member 140 to the main body member 130, and an unlocked position (FIG. 7), where the engaging member 170 does not engage the engagement surface 171 and the removable body member 140 can be removed or disconnected from the main body member 130. In the embodiment illustrated in FIGS. 3-7, the connecting element 160 is a rotatable member that includes a rotatable pin member 161 and a plate member 162, and the engaging member 170 is formed by at least a portion of the plate member 162. The rotatable connecting element 160 of this embodiment rotates to move the engaging member 170 between the locked and unlocked positions, as shown in FIGS. 4-7 and discussed in greater detail below. In other embodiments, the connecting element 160 may have a different engaging member 170, or the connecting element 160 may be movable in a different manner, such as by sliding, pivoting, rotating on a different axis, etc.

The main body member 130 contains the engagement surface 171, and may also contain other structure adapted for interaction with the connecting member 160. In the embodiment illustrated in FIGS. 3-7, the engagement surface 171 is defined by a slot 172 located on the back end 127 of the main body member 130. The main body member 130 of this embodiment contains an integral block 173 that is formed on the back end 127 thereof, and the slot 172 extends a portion of the distance through the block 173, such that the slot 172 has an open end 174 to receive the engaging member 170. Additionally, the slot 172 has at least a ramp portion 175 that is tapered, which facilitates entry of the engaging member 170 into the slot and allows the engaging member 170 to gradually engage the engagement surface 171 and the removable body member 140 to be gradually snugged to the main body member 130. The tapered portion or ramp portion 175 also widens the open end 174 of the slot 172, which permits a greater degree of tolerance between the structural components of the main body member 130 and the removable body member 140. In this embodiment, the slot 172 is laterally elongated (i.e. extending in a direction between the heel 120 and the toe 122 of the head 102) to receive the plate 162 that is rotating on a horizontal axis, as described below. It is understood that in other embodiments, including embodiments where a connecting element of a different type and/or orientation is used, the main body member 130 may include a slot 172 that is structured or oriented differently, and the slot 172 may extend completely through the block 173 in one embodiment. In further embodiments, the main body member 130 may not contain a slot, and may contain an engagement surface 171 of a different type and/or configuration. For example, the main body member 130 may contain an engagement surface 171 as shown in FIGS. 3-7, but without an opposed surface to form a slot, such that the engaging member 170 simply rests behind the engagement surface 171 to exert a horizontal retaining force component.

In the embodiment shown in FIGS. 3-7, the main body member 130 also contains a circular recess 176 on the back end 127. The circular recess 176 receives the end of the connecting element 160, as shown in FIGS. 4-7, and provides clearance for the end of the connecting element 160. The recess 176 may also aid in alignment of the removable body member 140 during assembly.

Figure 8:
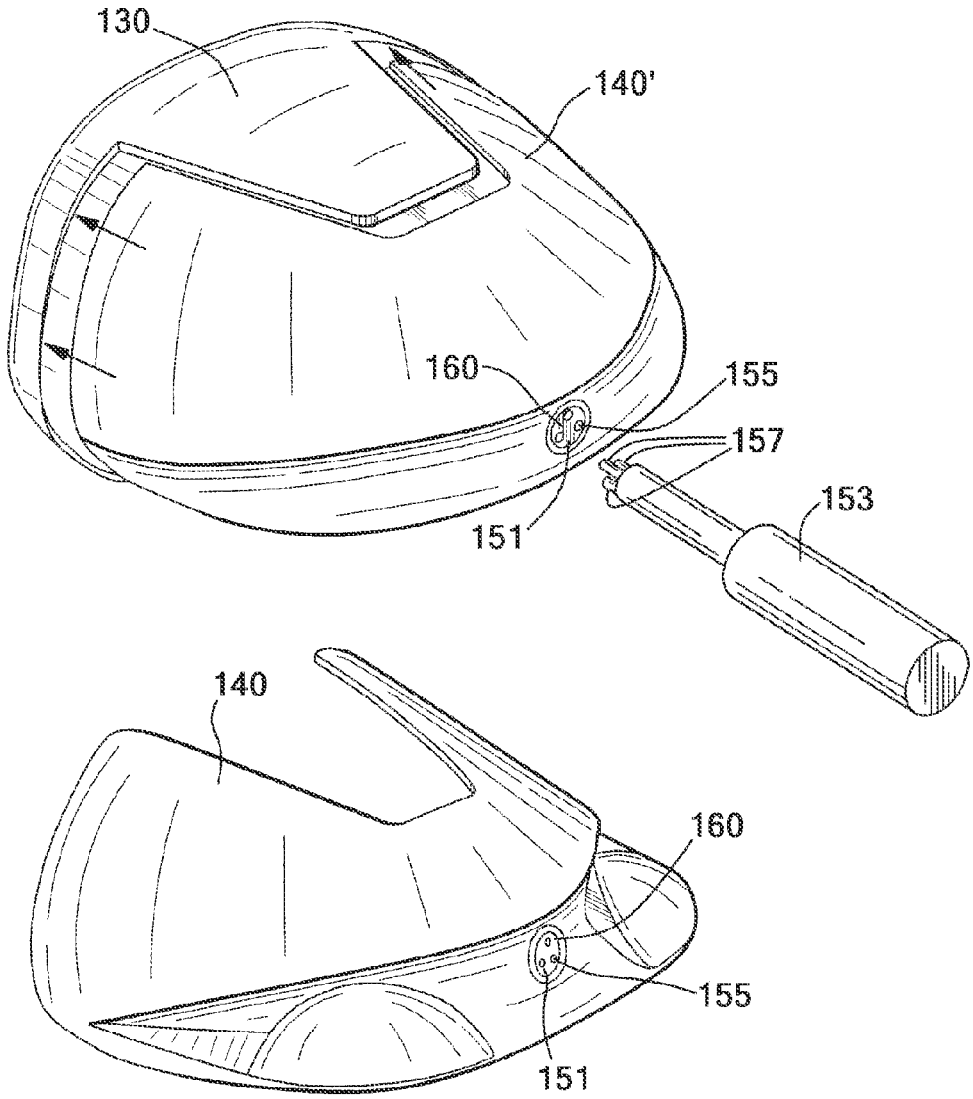
FIG. 8 is a bottom rear perspective view of the head of FIG. 1, with the removable body member removed from the head and a different removable body member shown being attached to the head.
Figure 9:
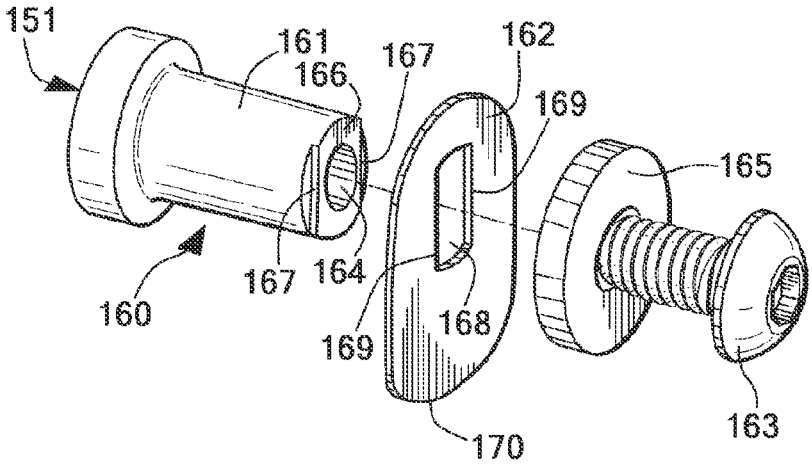
FIG. 9 is an exploded perspective view of an illustrative embodiment of the connecting element of the head as shown in FIGS. 1-7.
Figure 10:
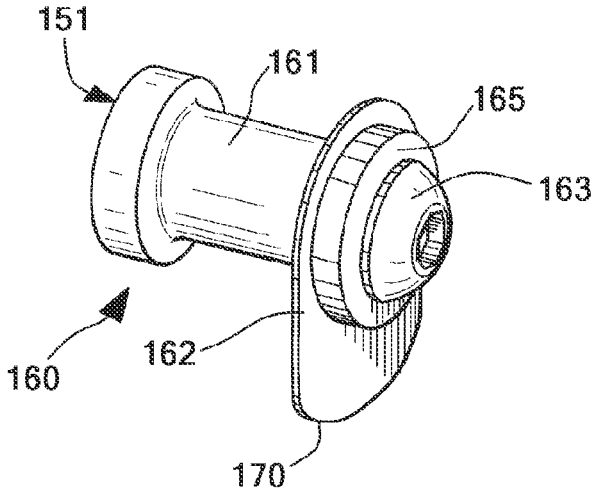
FIG. 10 is a perspective view of the connecting element of FIG. 9, as assembled.

The example embodiment of the connecting element 160 shown in FIGS. 3-7 is illustrated in greater detail in FIGS. 9-10. As shown in FIGS. 9-10, the connecting element 160 includes the pin 161 and the plate 162, with a fastener in the form of a screw 163 connecting the plate 162 to the pin 161. As described above, in this embodiment, at least a portion of the plate 162 forms the engaging member 170 for engaging the engagement surface 171 of the main body member 130. Further, the plate 162 extends asymmetrically with respect to the axis of rotation R of the connecting element 160, and the plate 162 may be referred to as a cam member that selectively engages the engagement surface 171 of the main body member 130 based on the degree of rotation of the connecting element 160. The screw 163 is received in a hole 164 in the pin 161, and a washer 165 is positioned between the screw 163 and the plate 162. Additionally, the pin 161 and the plate 162 are cooperatively dimensioned to lock together to prevent rotation of the plate 162 relative to the pin 161. In this embodiment, the pin 161 has a protruding end portion 166 with flattened or beveled edges 167, and the plate 162 has an opening 168 with complementary flattened or beveled edges 169. The end portion 166 of the pin 161 is received in the opening 168 of the plate 162, and the beveled edges 167, 169 of the plate 162 and the pin 161 engage each other to rotationally lock the plate 162 and the pin 161 together, preventing relative rotation of the plate 162 and the pin 161. In this embodiment, the connecting element 160 also includes an engagement portion 151 that is adapted for engagement by a specialized tool 153 to manipulate the connecting element 160. As shown in FIG. 8, the engagement portion 151 of the connecting element 160 has a plurality of holes 155 that are adapted to receive prongs 157 on the end of the tool 153 to enable manipulation of the connecting element 160 through the tool 153. In other embodiments, the connecting element 160 may have a different engagement portion configured for manipulation in a different manner, such as being adapted for engagement by a different tool or device, or being adapted for manual engagement. In one embodiment, the engagement portion 151 may be configured for engagement by a non-specialized tool, such as a screwdriver, Allen wrench, socket, etc.

Figure 4:
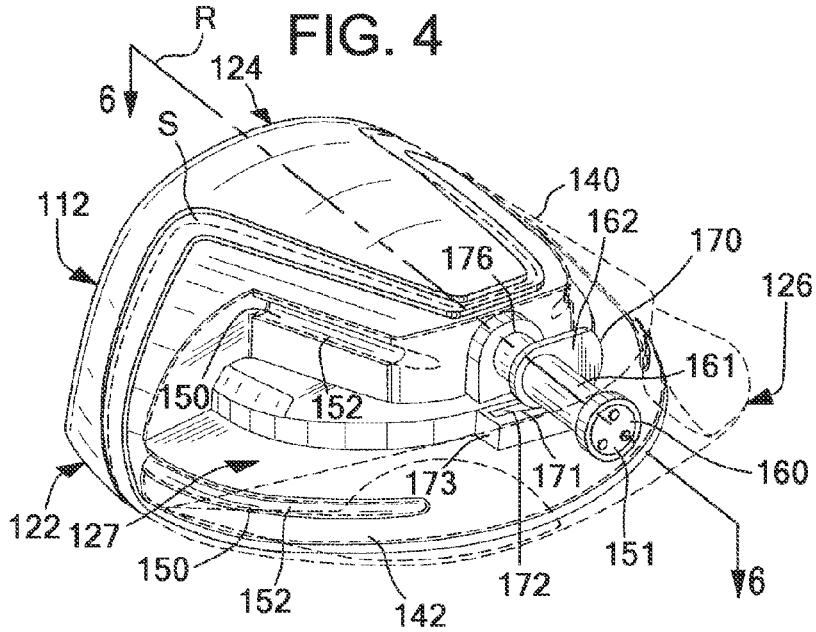
FIG. 4 is a bottom rear perspective view of the head of FIG. 1, with the removable body member shown as transparent to show internal detail, and with a connecting element shown in an unlocked position.
Figure 5:
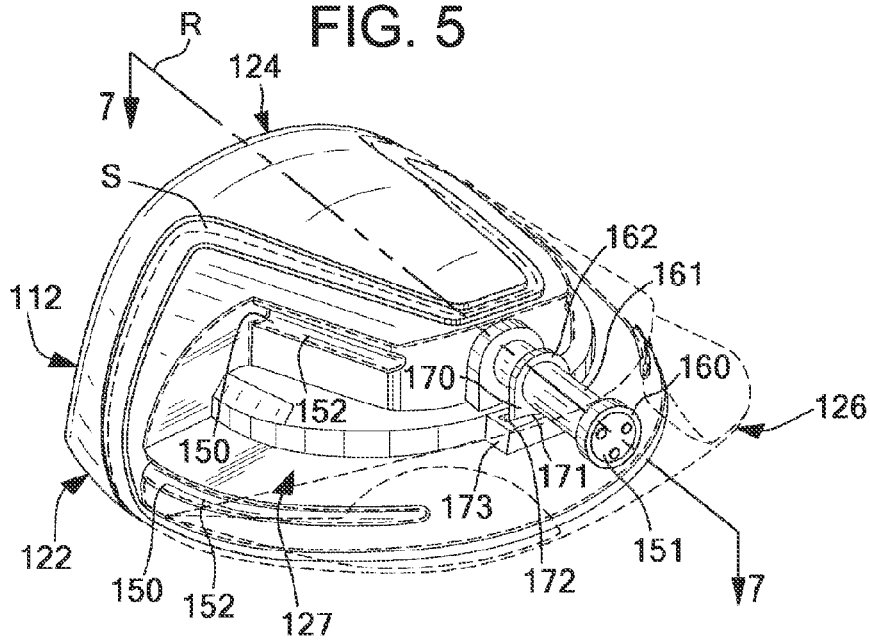
FIG. 5 is a bottom rear perspective view of the head of FIG. 1, with the removable body member shown as transparent to show internal detail, and with the connecting element shown in a locked position.
Figure 6:
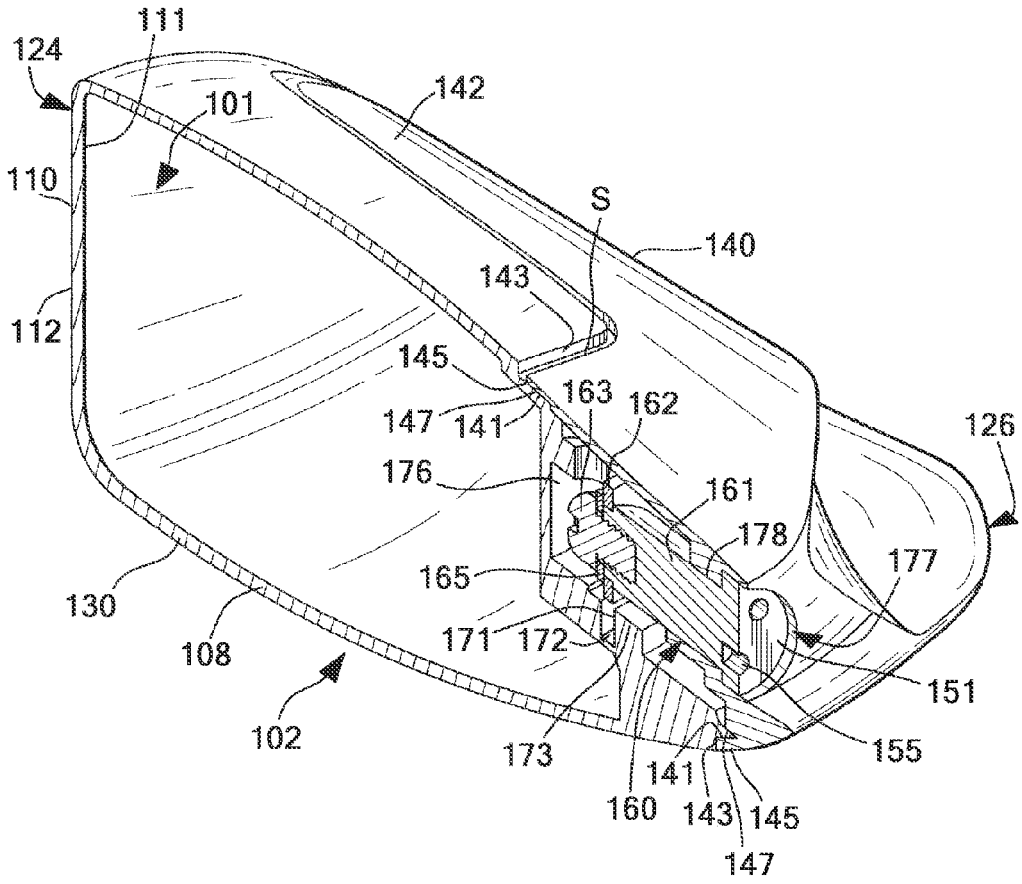
FIG. 6 is a cross-sectional view of the head of FIG. 4, taken along lines 6-6 of FIG. 4.
Figure 7:
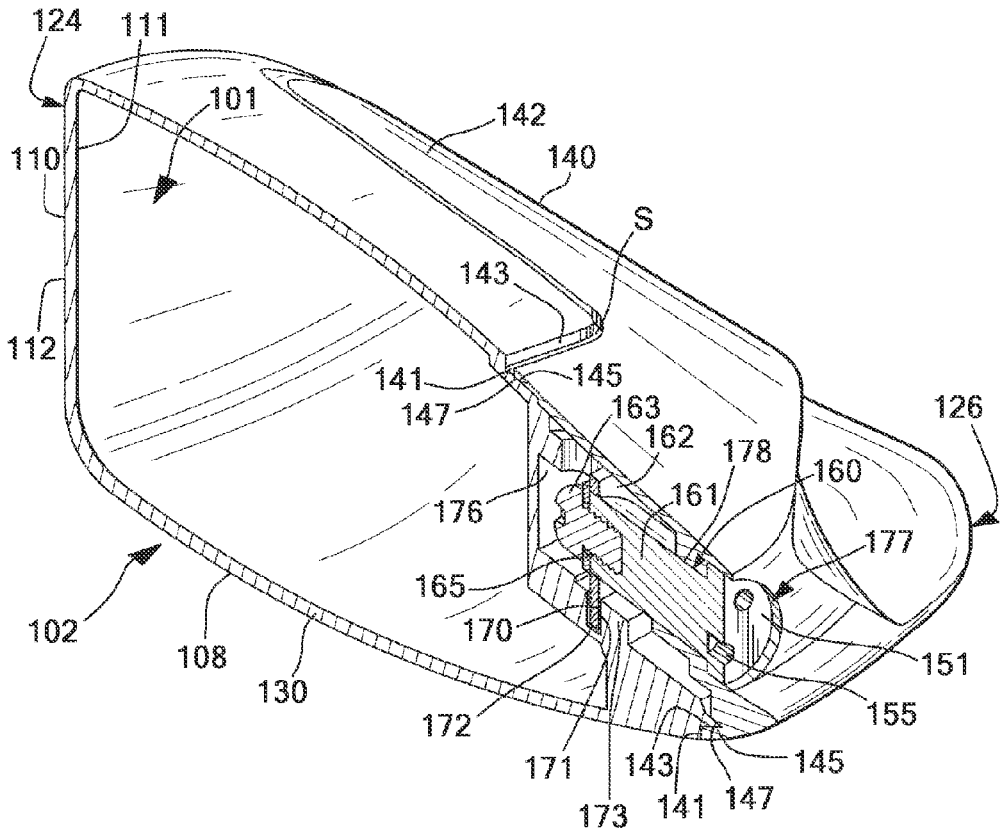
FIG. 7 is a cross-sectional view of the head of FIG. 5, taken along lines 7-7 of FIG. 5.

In the embodiment shown in FIGS. 2-7, the connecting element 160 is rotatably mounted to the removable body member 140 in a permanent or semi-permanent manner. The removable body member includes an external opening 177 that receives the pin 161 of the connecting element 160 therethrough, and a bore 178 in communication with the opening 177 that holds the pin 161 and stabilizes the connecting element 160, as shown in FIGS. 6-7. In this configuration, the connecting element 160 is oriented on an axis of rotation R (see FIGS. 4-5) defined by the bore 178, and is rotatable by rotation of the pin 161 on the axis of rotation R. When the removable body member 140 is connected to the main body member 130, the axis of rotation R extends in a horizontal direction (i.e. extending in a direction between the front 124 or face 112 and the rear 126 of the head 102). Additionally, in this embodiment, the plate 162 extends radially outward from the pin 161, in a direction generally perpendicular to the axis of rotation R. In other embodiments, the connecting element 160 may be permanently or semi-permanently mounted to the removable body member 140 in a different configuration, and may be mounted in another moveable configuration, which may be related to the design of the connecting element 160.

The removable body member 140 shown in FIGS. 2-7 can be connected to the main body member 130 as illustrated in FIGS. 4-8. In this embodiment, the removable body member 140 is positioned and aligned for connection to the main body member 130 so that the ridges 152 are aligned for insertion into the channels 150. With the connecting element 160 in the unlocked position, as shown in FIGS. 4 and 6, the removable body member 140 is then pushed toward the main body member 130 and toward the front 124 of the head, in the direction of the arrows in FIG. 8. Once the removable body member 140 is pushed far enough that the plate 162 can be received in the open end 174 of the slot 172, the connecting element 160 is manipulated to rotate the connecting element 160 from the unlocked position to the locked position, causing the plate 162 to enter the slot 172 and engage the engagement surface 171 to secure the removable body member 140 in place, as shown in FIGS. 5 and 7. This manipulation may be accomplished, in this embodiment, by engaging the tool 153 with the engagement portion 151 of the connecting element 160, as shown in FIG. 8. In this embodiment, the connecting element 160 is rotated approximately a quarter-turn (~90°) in the clockwise direction in FIGS. 4-7 to move from the unlocked position to the locked position. As described above, the engagement of the plate 162 with the tapered portion 175 may gradually pull the removable body member 140 further into contact with the main body member 130, creating a more snug connection. After the removable body member 140 is locked in place, the ridges 152 engage the channels 150 to exert a vertical retaining force component (i.e. between the top 116 and the sole 118) and a lateral retaining force component (i.e. between the heel 120 and the toe 122) on the removable body member 140 to retain the removable body member 140 to the main body member 130, as described above. Additionally, the connecting element 160 and the engagement surface 171 exert a horizontal retaining force component (i.e. between the front 124 and the rear 126) on the removable body member 140 to retain the removable body member 140 to the main body member 130 in this embodiment. In other words, in this embodiment, the connecting structure between the main body member 130 and the removable body member 140, including the projections 152, the notches 150, the connecting element 160, and the engagement surface 171, exert retaining forces along all three dimensional axes to secure the removable body member 140 against movement. As also described above, the flange 145 of the removable body member 140 contacts the recessed portion 141 of the main body member 130 to seal the juncture between the two members 130, 140 after the removable body member 140 is locked in place.

It is understood that the projections 152, notches 150, connecting element 160, and engagement surface 171 may exert other force components on the removable body member 140 in addition to the vertical, horizontal, and/or lateral retaining force components discussed above. In other words, each of these components may exert a force vector on the removable body member 140 that includes two or more force components. For example, the connecting member 160 and the engagement surface 171 may exert a vertical and/or lateral force component on the removable body member 140, in addition to the horizontal force component described above.

The projections 152 and notches 150 may similarly exert additional force components. In one embodiment, the connecting member 160 and the engagement surface 171 may exert a primarily horizontal force on the removable body member, where the horizontal force component is larger than any vertical or lateral force component, and the projections and notches 150 may exert primarily vertical or lateral forces on the removable body member 140.

In other embodiments, where the configuration(s) and/or orientation(s) of the main body member 130, the removable body member 140, and/or the connecting element 160 are different, the connections between these components and the forces exerted by these components may differ as well.

The removable body member 140 can be disconnected from the main body member 130 in a similar manner. The connecting element 160 in the locked position, as shown in FIGS. 5 and 7, is manipulated to rotate the connecting element 160 to the unlocked position, as shown in FIGS. 4 and 6, such as through use of the specialized tool 153. In this embodiment, the connecting element 160 is rotated approximately a quarter-turn (~90°) in the counterclockwise direction in FIGS. 4-7 to move from the locked position to the unlocked position. Once the connecting element 160 is unlocked, the removable body member 140 can be pulled away from the main body member 130.

The main body member 130 may be adapted for interchangeable connection to any of a plurality of different removable body members 140. For example, FIG. 8 illustrates the removable body member 140 of FIGS. 2-7 being removed from the main body member 130 and a second, differently-shaped removable body member 140' being attached to the main body member 130. Interchanging the removable body members 140, 140' can be accomplished as described above, by unlocking the connecting element 160 and removing the first removable body member 140, and then connecting the second removable body member 140' and locking the connecting element 160 thereof. Any number of additional removable body members may be configured for connection to the main body member 130. In one embodiment, each of the different removable body members 140, 140' includes a similar or substantially identical connecting element 160 or a different connecting element 160 with a similar or substantially identical engaging member 170, as well as similar or substantially identical internal mating structures (such as projections 152), to enable connection of any of the removable body members 140, 140' to the main body member 130. In another embodiment, even if the removable body members 140, 140' include different connecting elements 160, each of the connecting elements 160 may have a similar engagement portion 151, to permit manipulation of any of the connecting elements 160 using the same tool 153.

Interchanging of removable body members 140, 140' can achieve changing the characteristics, properties, performance, etc. of the head 102. For example, as seen in FIG. 8, the removable body member 140 of FIGS. 2-7 has a generally square or rectangular shape, and the second removable body member 140' has a generally rounded shape. The different shapes of these removable body members 140, 140' allow the weighting characteristics of the head 102, including the center of gravity and moment of inertia of the head 102, as well as other characteristics, to be changed by interchanging the removable body members 140, 140'. This, in turn, can affect various characteristics of the swing of the head 102, the impact of the ball on the face 112, and/or the flight of the ball after contact with the face 112. One or a plurality of other different removable body members 140 can also be interchanged in this manner. Such other removable body members 140 may have one or more unique or different characteristics, such as a different shape, a different material, a different density, a different weight distribution, a different surface contour or texture, or a different aerodynamic profile, as well as many other differing characteristics.

In one embodiment, the removable body member 140 can be used to customize the head 102 to a specific golfer's swing. For example, the removable body member 140 may have a weight distribution that offsets the center of gravity of the head 102 to compensate for a detected off-center hitting pattern by the specific golfer. Customization of the head 102 in this instance may include determining such a pattern and selecting a removable body member 140 that is appropriately weighted to produce improved performance. In another embodiment, the removable body member 140 can be used to customize the head 102 to a specific type of desired ball flight, such as promoting draws or fades. Customizing the head 102 for different ball flights may allow for customization to course conditions, for example, a player may desire a less lofted, more penetrating ball flight for a wet course or a more lofted ball flight with less roll for a dry course. Similarly, customizing the head 102 for different ball flights may allow for customization to play conditions, for example, a player may desire a lower, more penetrating ball flight for windy conditions, as opposed to calmer conditions. In a further embodiment, the removable body member 140 can be used to customize the head 102 mimic or correspond to another golfer's club weighting or swing characteristics, such as those of a particular professional golfer. For example, a removable body member 140 may be weighted similarly to a tour professional's club, allowing a player to use a club that is set up the same as the professional's club. Additionally, a kit may be provided as described below, containing one removable body member customized for the player's own swing and another removable body member customized for a professional golfer's swing. Still other variations are possible within the scope of the present invention.

FIGS. 11-19 illustrate different embodiments of rotatable connecting elements 160 that can be used to exert a horizontal retaining force component to retain the removable body member 140 to the main body member 130. These connecting elements 160A-D can be used with the removable body member 140 of FIGS. 1-7, as well as other removable body members.

Figure 11:
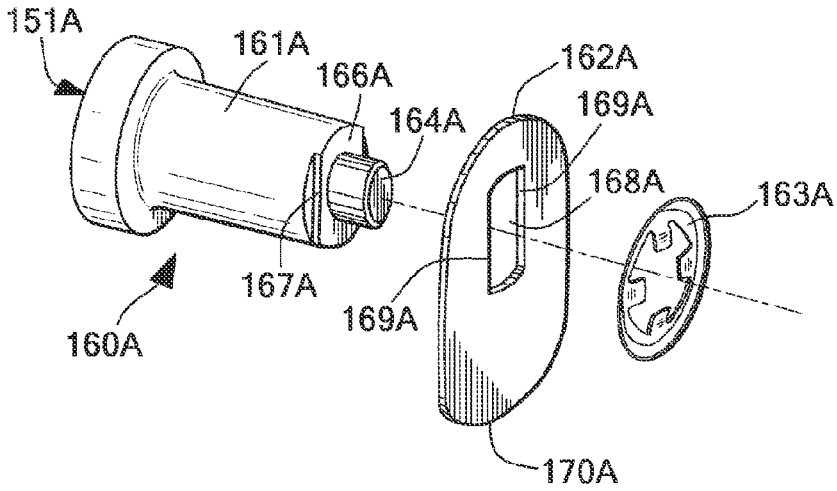
FIG. 11 is an exploded perspective view of a second illustrative embodiment of the connecting element of a head of a ball striking device.
Figure 12:
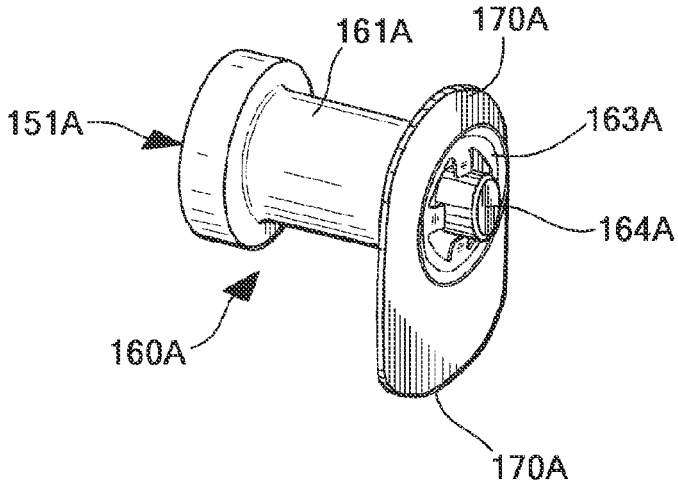
FIG. 12 is a perspective view of the connecting element of FIG. 11, as assembled.

FIGS. 11-12 illustrate one embodiment of a rotatable connecting element 160A that includes a rotatable pin 161A and a plate 162A connected to the pin 161A and extending radially outward from the pin 161A. The connecting element 160A also includes a fastener in the form of a lock ring or retaining clip 163A that snaps onto an end protrusion 164A on the pin 161A to connect the plate 162A to the pin 161A. In this embodiment, at least a portion of the plate 162A forms an engaging member 170A for engaging an engagement surface of the main body member 130. The plate 162A in FIGS. 11-12 is similar to the plate 162 shown in FIGS. 9-10, and is capable of being received in the slot 172 and engaging the engagement surface 171 of the main body member 130 shown in FIGS. 3-7. Additionally, the pin 161A and the plate 162A are cooperatively dimensioned to lock together to prevent rotation of the plate 162A relative to the pin 161A. In this embodiment, the pin 161A has an end portion 166A with flattened or beveled edges 167A, and the plate 162A has an opening 168A with complementary flattened or beveled edges 169A, similar to the connecting element 160 in FIGS. 9-10. The end portion 166A of the pin 161A is received in the opening 168A of the plate 162A, and the beveled edges 167A, 169A of the plate 162A and the pin 161A engage each other to rotationally lock the plate 162A and the pin 161A together, preventing relative rotation of the plate 162A and the pin 161A. The connecting element 160A also includes an engagement portion 151A that is adapted for engagement to manipulate the connecting element 160A between the locked and unlocked positions.

Figure 13:
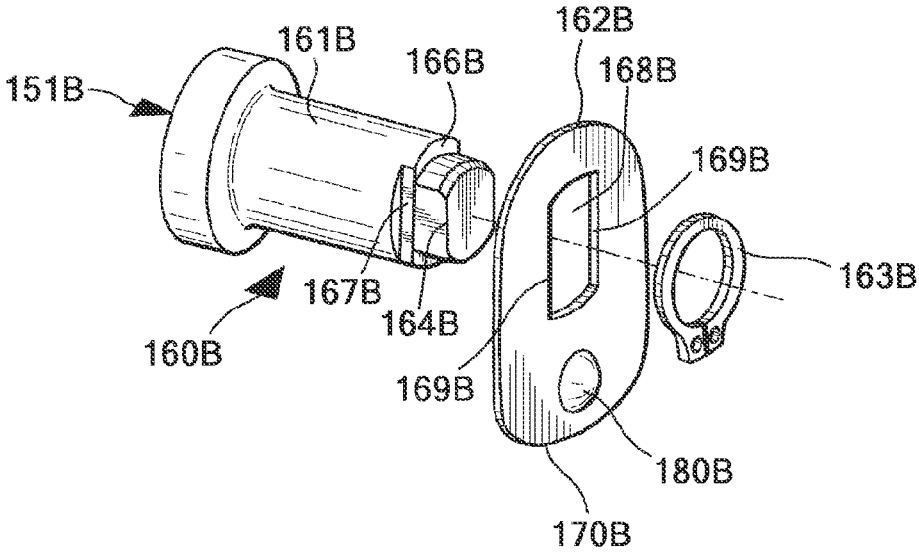
FIG. 13 is an exploded perspective view of a third illustrative embodiment of the connecting element of a head of a ball striking device.
Figure 14:
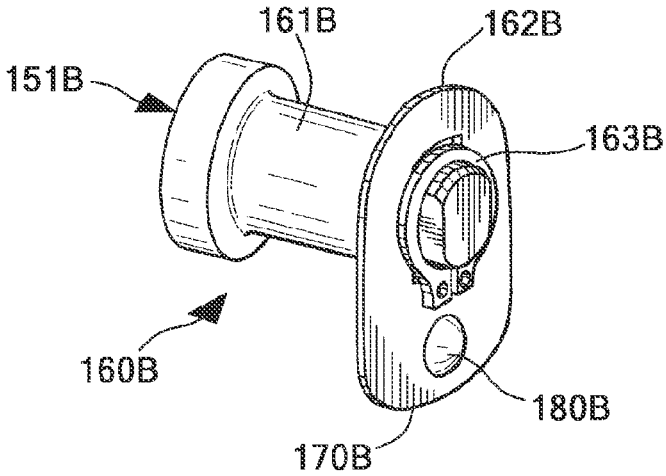
FIG. 14 is a perspective view of the connecting element of FIG. 13, as assembled.
Figure 15:
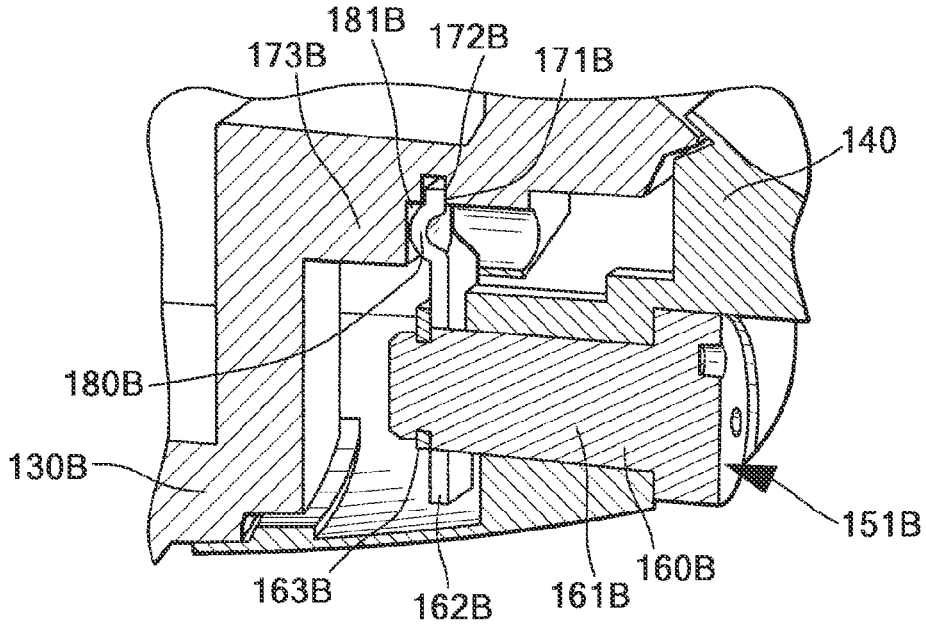
FIG. 15 is a cross-sectional view of a portion of a second illustrative embodiment of a ball striking head including the connecting element of FIG. 13.

FIGS. 13-15 illustrate another embodiment of a rotatable connecting element 160B that includes a rotatable pin 161B and a plate 162B connected to the pin 161B and extending radially outward from the pin 161B. The connecting element 160B also includes a fastener in the form of a retaining ring 163B that snaps onto an end protrusion 164B on the pin 161B to connect the plate 162B to the pin 161B. In this embodiment, at least a portion of the plate 162B forms an engaging member 170B for engaging an engagement surface of the main body member 130. The plate 162B in FIGS. 13-15 is similar to the plates 162, 162A shown in FIGS. 9-10 and 11-12, but further includes a protrusion 180B located proximate the free end of the plate 162B. Additionally, the pin 161B and the plate 162B are cooperatively dimensioned to lock together to prevent rotation of the plate 162B relative to the pin 161B. In this embodiment, the pin 161B has an end portion 166B with flattened or beveled edges 167B, and the plate 162B has an opening 168B with complementary flattened or beveled edges 169B, similar to the connecting element 160 in FIGS. 9-10. The end portion 166B of the pin 161B is received in the opening 168B of the plate 162B, and the beveled edges 167B, 169B of the plate 162B and the pin 161B engage each other to rotationally lock the plate 162B and the pin 161B together, preventing relative rotation of the plate 162B and the pin 161B. The connecting element 160B also includes an engagement portion 151B that is adapted for engagement to manipulate the connecting element 160B between the locked and unlocked positions.

In the embodiment illustrated in FIGS. 13-15, the plate 162B of the connecting element 160B is configured for engaging a main body member 130B that has an engagement surface 171B that is positioned within a slot 172B that has a detent 181B that receives at least a portion of the protrusion 180B when the engaging member 170B engages the engagement surface 171B, as shown in FIG. 15. The main body member 130B shown in FIG. 15 has the engagement surface 171B defined by a slot 172B located in a block 173B, and the slot 172B has an open end (not shown) designed to receive the plate 162B therein, similarly to the slot 172 shown in FIGS. 3-7. When the connecting element 160B is in the locked position, the protrusion 180B is received in the detent 181B to resist slippage of the plate 162B out of the slot 172B. The main body member 130B illustrated in FIG. 15 is otherwise similar to the main body member 130 as shown in FIGS. 3-7, but it is understood that this configuration can be used with different embodiments of the main body member.

Figure 16:
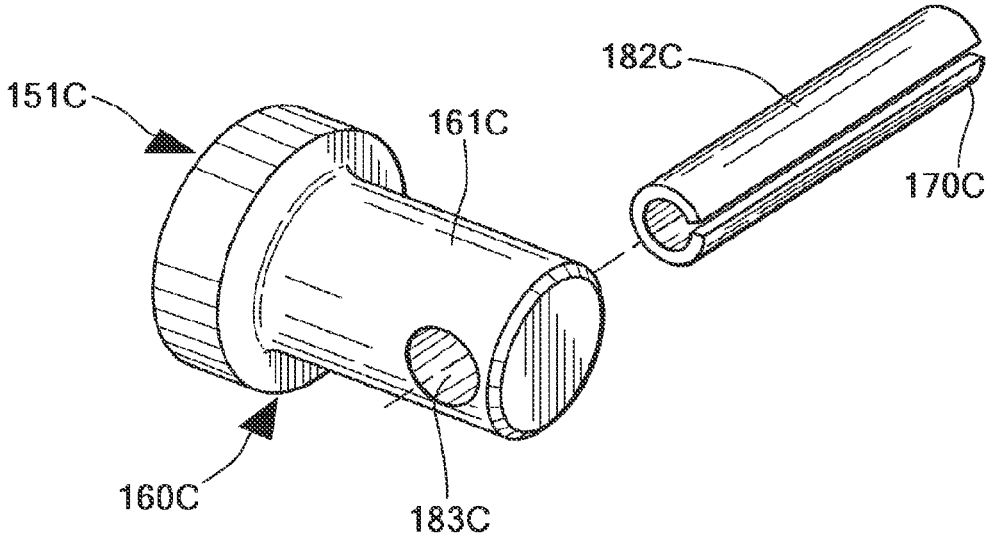
FIG. 16 is an exploded perspective view of a fourth illustrative embodiment of the connecting element of a head of a ball striking device.
Figure 17:
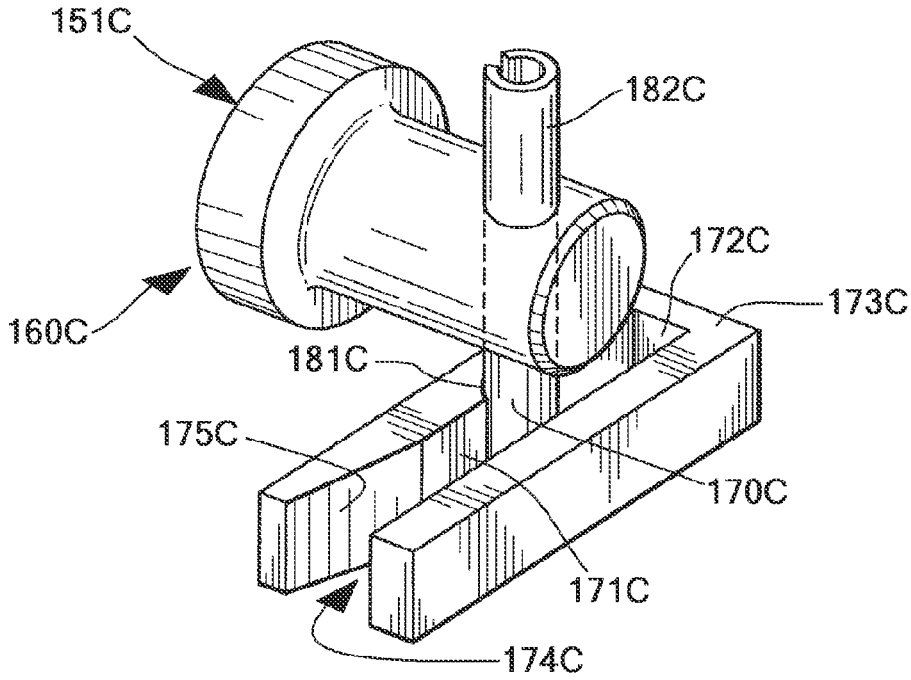
FIG. 17 is a perspective view of the connecting element of FIG. 16, as assembled, shown engaging an engaging surface of a head of a ball-striking device.

FIGS. 16-17 illustrate another embodiment of a rotatable connecting element 160C that includes a rotatable pin 161C and a rod 182C connected to the pin 161C and extending radially outward from the pin 161C. The pin 161C has an aperture 183C extending therethrough, and the rod 182C is received in the aperture 183C to connect the rod 182C to the pin 161C. In this embodiment, the rod 182C may be held within the aperture 183C by an interference fit, and the rod 182C is partially hollowed to make it capable of compression to achieve this connection. The connection may additionally or alternately incorporate adhesive, cement, welding, brazing, soldering, etc. In this embodiment, at least a portion of the rod 182C forms an engaging member 170C for engaging an engagement surface of the main body member. As illustrated in FIG. 17, the engagement surface 171C may be defined by a slot 172C located in a block 173C, with the slot 172C having an open end 174C with a tapered portion 175C designed to receive the rod 182C therein, similarly to the slot 173 shown in FIGS. 3-7. Additionally, the engagement surface 171C may have a detent 181C therein, and when the connecting element 160C is in the locked position, the rod 182C is received in the detent 181C to resist slippage of the rod 182C out of the slot 172B. It is understood that the engagement surface 171C may be part of a main body member that is otherwise similar to the main body member 130 as shown in FIGS. 3-7, but it is understood that this configuration can be used with different embodiments of the main body member. The connecting element 160C in this embodiment also includes an engagement portion 151C that is adapted for engagement to manipulate the connecting element 160C between the locked and unlocked positions.

Figure 18:
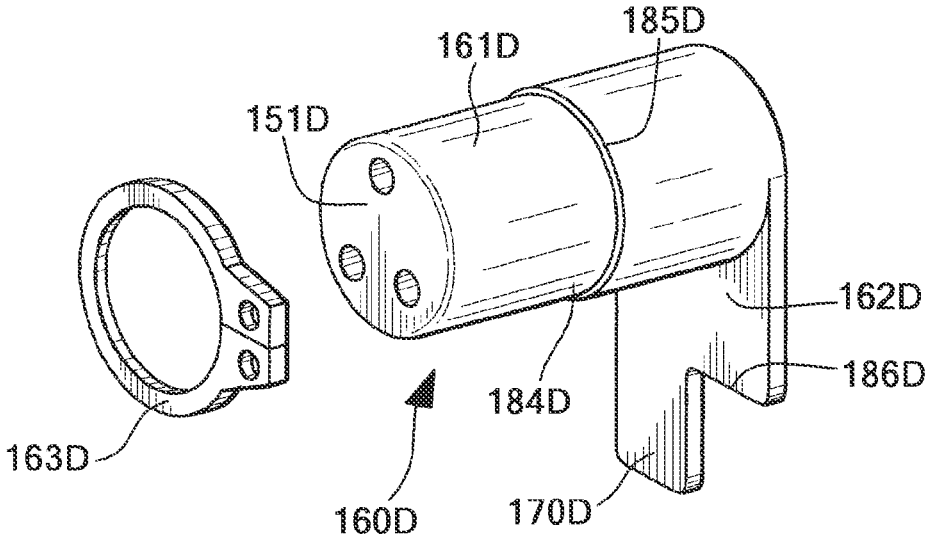
FIG. 18 is an exploded perspective view of a fifth illustrative embodiment of the connecting element of a head of a ball striking device.
Figure 19:
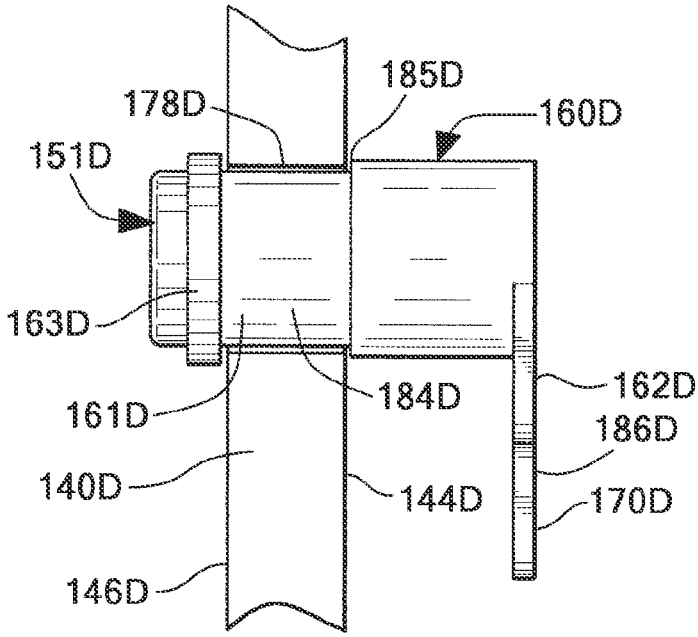
FIG. 19 is a perspective view of the connecting element of FIG. 18, as assembled, shown connected to a removable body member of a ball striking head.

FIGS. 18-19 illustrate a further embodiment of a rotatable connecting element 160D that includes a rotatable pin 161D and a plate 162D connected to the pin 161D and extending radially outward from the pin 161D. In this embodiment, the pin 161D and the plate 162D are formed as a single integral piece. Additionally, in this embodiment, the pin 161D includes a ridge 185D defining a recessed portion 184D that is configured to extend through a bore 178D in the wall of the removable body member 140D to connect the connecting element 160D to the removable body member 140D, as shown in FIG. 19. Once the recessed portion 184D of the pin 161D is inserted through the bore 178D, a retaining ring 163D is connected to the end of the pin 161D, and the retaining ring 163D combines with the ridge 185D on the pin 161D to engage the inner and outer surfaces 144D, 146D of the removable body member 140D to rotatably connect the connecting element 160D to the removable body member 140D. In this embodiment, at least a portion of the plate 162D forms an engaging member 170D for engaging an engagement surface of the main body member 130. The plate 162D in FIGS. 18-19 has a cut-out portion 186D and is capable of being received in the slot 172 and engaging the engagement surface 171 of the main body member 130 shown in FIGS. 3-7. The connecting element 160D also includes an engagement portion 151D that is adapted for engagement to manipulate the connecting element 160D between the locked and unlocked positions.

The engagement portions 151A-D of the connecting elements 160A-D shown in FIGS. 11-19 may be adapted for engagement by the specialized tool 153 shown in FIG. 8 to manipulate the connecting element 160A-D, or for engagement in a different manner, as described above with respect to the connecting element 160 of FIGS. 9-10. It is also understood that the connecting element 160 in FIGS. 2-7 and 9-10 and the connecting elements 160A-D illustrated in FIGS. 11-19 can be oriented differently to exert a primarily vertical or lateral retaining force component on the removable body member 140, or a force vector that incorporates one or more of horizontal, vertical, and/or lateral retaining force vectors.

Figure 20:
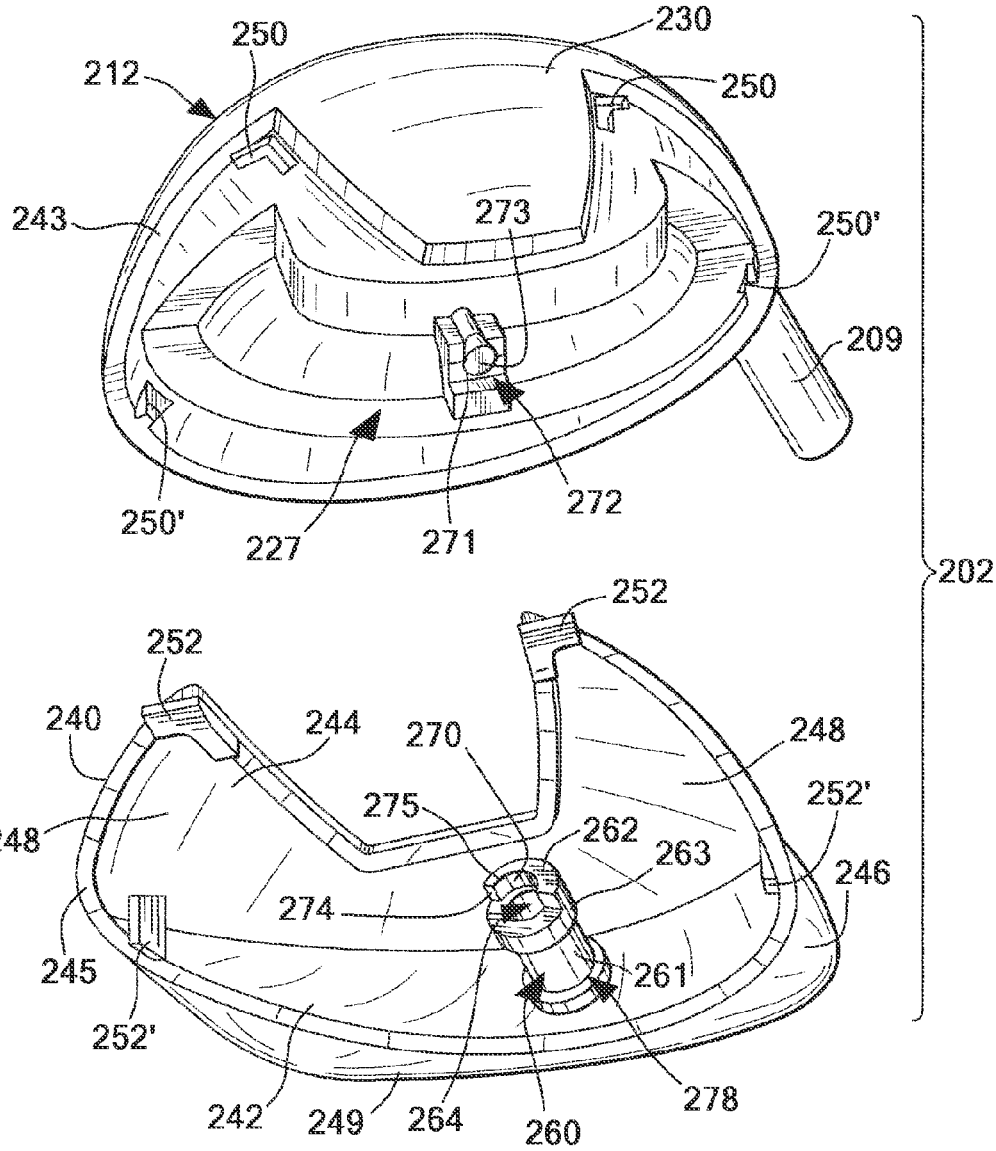
FIG. 20 is an exploded rear view of a third illustrative embodiment of a head of a ball striking device according to the present invention, with a removable body member removed from the head to show internal detail.
Figure 21:
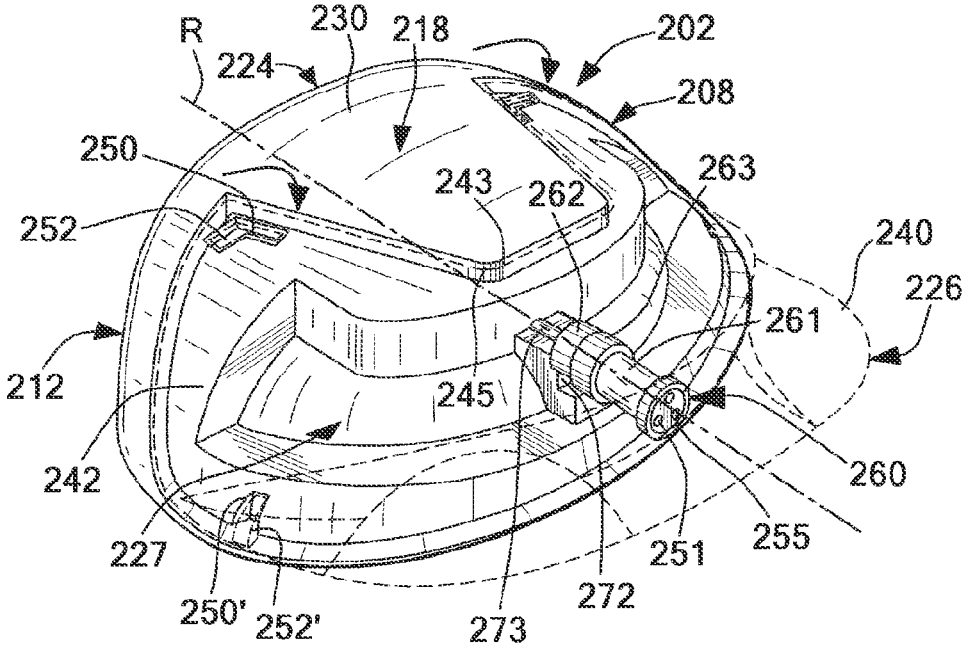
FIG. 21 is a bottom rear perspective view of the head of FIG. 20, with the removable body member shown as transparent to show internal detail, and with a connecting element shown in an unlocked position.
Figure 22:
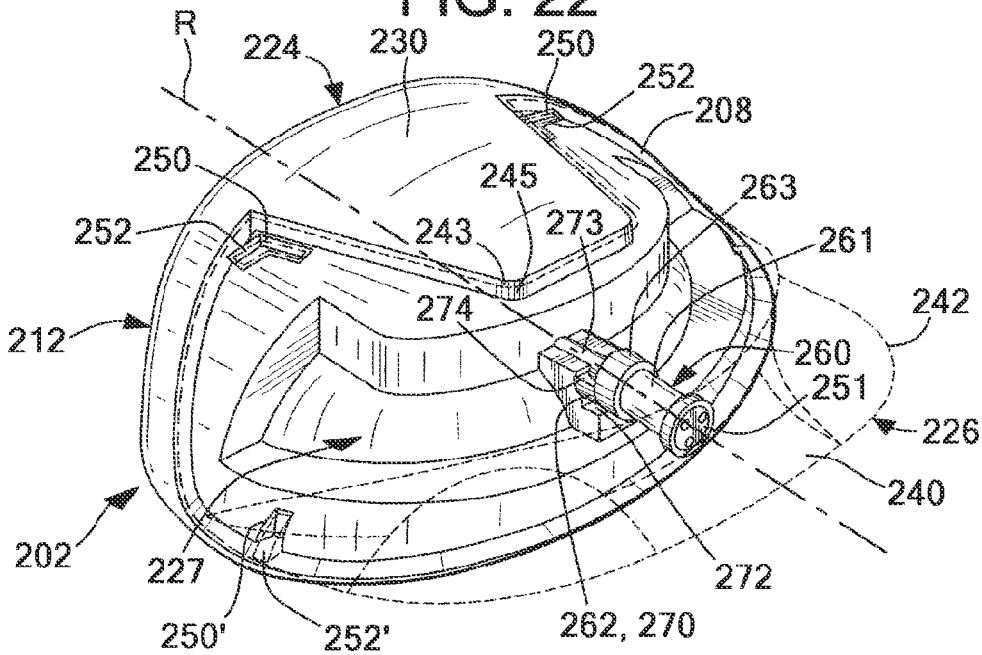
FIG. 22 is a bottom rear perspective view of the head of FIG. 20, with the removable body member shown as transparent to show internal detail, and with the connecting element shown in a locked position.

A second illustrative embodiment of a ball striking head 202 is shown in FIGS. 20-22, and is described using the "2XX" series of reference numerals. Many of the features of this embodiment of the head 202 have been described above with respect to the head 102 shown in FIGS. 1-8, and duplicate descriptions of such features with respect to the head 202 may be abbreviated or eliminated, with similar reference numerals used to describe common features with the "2XX" series, rather than the "1XX" series of reference numerals.

The embodiment of the head 202 in FIGS. 20-22 includes a face 212, a body 208 connected to the face 212, and a hosel 209, as described above. A main body member 230 and a removable and interchangeable body member 240 combine to form the body 208 of the head 202, as also described above.

The main body member 230 and the removable body member 240 in FIGS. 20-22 include some features that are different from those of the main body member 130 and the removable body member 140 described above with respect to FIGS. 1-8.

In the embodiment shown in FIGS. 20-22, the removable body member 240 includes a frame member 242 and a connecting element 260 connected to the frame member 242. The connecting element 260 is movable to connect and disconnect the removable body member 240 to and from the main body member 230, as described below. The frame member 242 is complementarily shaped with the back end 227 of the main body member 230 to facilitate the connection between the removable body member 240 and the main body member 230. For example, as shown in FIG. 20, the back end 227 of the main body member 230 is generally convex, and the frame member 242 has a concave configuration, with a generally concave inner surface 244 and a generally convex outer surface 246 to fit around the back end 227 of the main body member 230. In this embodiment, the frame member 242 may also be regarded as being generally U-shaped, having two opposed arms 248 and a bridge member 249 extending between the arms 248.

The complementary shape of the frame member 242 and the main body member 230 may also include interlocking structures to further secure the removable body member 240 to the main body member 230, such as one or more interlocking projections and notches. In the embodiment shown in FIGS. 20-22, the back end 227 of the main body member 230 has a plurality of notches 250, 250' on the outer surface in the form of two hinge notches 250 and two vertical notches 250' located on the back end 227 of the main body member 230. Additionally, the frame member 242 has a plurality of projections 252, 252' on the inner surface 244 that interlock with the notches 250, 250', in the form of two hinge projections 252 that are cooperatively dimensioned to be received within the corresponding hinge notches 250, and two vertical projections 252' that are dimensioned to be received within the corresponding vertical notches 250'. In this embodiment, the removable body member 240 can be connected to the main body member 230 by inserting the hinge projections 252 into the corresponding hinge notches 250 and pushing the connection together vertically in a hinge-like manner (i.e. from the top 216 to the sole 218 of the head 202) to insert the vertical projections 252' into the vertical notches 250', such as shown schematically in FIG. 21. The interlocking of the projections 252, 252' and the corresponding notches 250, 250' in this embodiment is shown, for example, in FIGS. 21-22. Once connected, the projections 252, 252' engage the notches 250, 250' to exert a horizontal retaining force component (i.e. between the front 224 and the rear 226 of the club head 202) and a lateral retaining force component (i.e. between the heel 220 and the toe 222) on the removable body member 240 to retain the removable body member 240 to the main body member 230. As described below, the connecting element 260 exerts a vertical retaining force component (i.e. between the top 116 and the sole 118) on the removable body member 240 to retain the removable body member 240 to the main body member 230 in this embodiment. The complementary shape of the frame member 242 and the main body member 230 in FIGS. 20-22 does not include overlapping perimeter structures as described above and shown in FIGS. 3-7, and the perimeter edge 243 of the main body member 230 and the perimeter edge 245 of the removable body member 240 confront each other in face-to-face relation. However, in other embodiments, the overlapping perimeter structures may be present.

The connecting element 260 shown in FIGS. 20-22 has an engaging member 270 that is configured to engage an engagement surface 271 on the main body member 230 to connect the removable body member 240 to the main body member 230. The connecting element 260 is a rotatable member that includes a rotatable pin member 261 and a ramped flange member 262 at the end of the pin 261, and the engaging member 270 is formed by at least a portion of the flange 262. The rotatable connecting element 260 of this embodiment rotates to move the engaging member 270 between the locked and unlocked positions, as shown in FIGS. 21-22 and discussed in greater detail below. In other embodiments, the connecting element 260 may have a different engaging member 270, or the connecting element 260 may be movable in a different manner, such as by sliding, pivoting, rotating on a different axis, etc.

The main body member 230 contains the engagement surface 271, and may also contain other structure adapted for interaction with the connecting member 260. In the embodiment illustrated in FIGS. 20-22, the engagement surface 271 is defined on a side surface of a peg 273 located on the back end 227 of the main body member 230. The main body member 230 of this embodiment has the peg 273 extending from the back end 227, and the slot 272 is defined beneath the peg 273 to receive the engaging member 270. In the unlocked position, shown in FIG. 21, the flange 262 is positioned on the outside of the slot 272 and is disengaged from the engagement surface 271, and when the connecting element 260 is moved to the locked position, the flange 262 enters the slot 272 and engages the engagement surface 271 on the peg 273, as shown in FIG. 22.

The flange 262 of the embodiment illustrated in FIGS. 20-22 is semicircular and extends around a portion of the perimeter of the connecting element and outwardly from the end of the pin 261 in a direction along the axis of rotation R of the pin 261. The engaging member 270 is defined along the inner perimeter of the flange 262, as shown in FIG. 20. Additionally, at least a portion 275 of the flange 262 is ramped or tapered, such that the flange 262 increases in thickness from a leading end 272 to an opposite end, as also shown in FIG. 20. The ramped portion 275 of the flange 262 facilitates entry of the engaging member 270 into the slot 272 and allows the engaging member 270 to gradually engage the engagement surface 271 and the removable body member 240 to be gradually snugged to the main body member 230, as the engaging member 270 is moved to the locked position. The tapered portion 275 also narrows the leading end 274 of the flange 262, which permits a greater degree of tolerance between the structural components of the main body member 230 and the removable body member 240. In this embodiment, the peg 273 extends in the horizontal direction (i.e. extending in a direction from the front 224 to the rear 226 of the head 202) to receive the flange 262 that is rotating on a horizontal axis, as described below. In further embodiments, the main body member 230 may not contain a peg, and may contain an engagement surface 271 of a different type and/or configuration. For example, the main body member 130 may contain an engagement surface 271 as shown in FIGS. 20-22, but without an opposed surface to form a slot, such that the engaging member 270 simply rests underneath the peg 273 to exert a vertical retaining force component.

The example embodiment of the connecting element 260 shown in FIGS. 20-22 includes the pin 261 and the flange 262, with the flange 262 being formed as part of a cap member 263 connected to the pin 261, such as by a fastener in the form of a screw (not shown) received in a hole 264 in the end of the connecting member 260. In another embodiment, the cap member 263 may be connected to the pin 261 by another means, such as by integral forming, welding or other integral joining technique, press-fit, interference fit, staking, or other connection techniques. As described above, in this embodiment, at least a portion of the inner perimeter of the flange 262 forms the engaging member 270 for engaging the engagement surface 271 of the main body member 230. Further, the flange 262 extends asymmetrically with respect to the axis of rotation R of the connecting element 260, and the flange 262 may be referred to as a cam member that selectively engages the engagement surface 271 of the main body member 230 based on the degree of rotation of the connecting element 260. In one embodiment, the pin 261 and the flange 262 may be cooperatively dimensioned to lock together to prevent rotation of the flange 262 relative to the pin 261, such as by using interlocking or mating structures. In this embodiment, the connecting element 260 also includes an engagement portion 251 that is adapted for engagement to manipulate the connecting element 260. The engagement portion 251 of this embodiment of the connecting element 260 has a plurality of holes 255 that are adapted to be engaged by a tool, such as the specialized tool 153 described above and shown in FIG. 8. In other embodiments, the connecting element 260 may have a different engagement portion configured for manipulation in a different manner, such as being adapted for engagement by a different tool or device, or being adapted for manual engagement.

In the embodiment shown in FIGS. 20-22, the connecting element 260 is rotatably mounted to the removable body member 240 in a permanent or semi-permanent manner. The removable body member includes a bore 278 that receives the pin 261 of the connecting element 260 therethrough, holding the pin 261 and stabilizing the connecting element 260, as shown in FIG. 20. In this configuration, the connecting element 260 is oriented on the axis of rotation R (see FIGS. 20-22) defined by the bore 278, and is rotatable by rotation of the pin 261 on the axis of rotation R. When the removable body member 240 is connected to the main body member 230, the axis of rotation R extends in a horizontal direction (i.e. extending in a direction between the front 224 or face 212 and the rear 226 of the head 202). Additionally, in this embodiment, the flange 262 extends axially outward from the pin 261, in a direction generally parallel to the axis of rotation R. In other embodiments, the connecting element 260 may be permanently or semi-permanently mounted to the removable body member 240 in a different configuration, and may be mounted in another moveable configuration, which may be related to the design of the connecting element 260.

The removable body member 240 shown in FIGS. 20-22 can be connected to the main body member 230 as illustrated in FIGS. 21-22. In this embodiment, the removable body member 240 is positioned and aligned for connection to the main body member 230 so that the hinge projections 252 are inserted into the hinge notches 250 to form a hinge point. With the connecting element 260 in the unlocked position, as shown in FIG. 21, the removable body member 240 is then pushed toward the main body member 230 in a hinge-like manner, in the direction of the arrows in FIG. 21, so that the vertical projections 252' are received in the vertical notches 250'. Once the removable body member 240 is pushed far enough that the flange 262 can be received in the slot 272, the connecting element 260 is manipulated to rotate the connecting element 260 from the unlocked position (FIG. 21) to the locked position (FIG. 22), causing the leading edge 274 of the flange 262 to enter the slot 272 and causing the engaging member 270 to engage the engagement surface 271 to secure the removable body member 240 in place, as shown in FIG. 22. This manipulation may be accomplished, in this embodiment, by engaging the tool 153 with the engagement portion 251 of the connecting element 260, as similarly shown in FIG. 8. In this embodiment, the connecting element 160 is rotated approximately a half-turn (~180°) in the clockwise direction in FIGS. 21-22 to move from the unlocked position to the locked position. As described above, the engagement of the tapered portion 275 of the flange 262 with the engagement surface 271 may gradually pull the removable body member 240 further into contact with the main body member 230, creating a more snug connection.

After the removable body member 240 is locked in place, the projections 252, 252' engage the notches 250, 250' to exert a horizontal retaining force component (i.e. between the front 224 and the rear 226) and a lateral retaining force component (i.e. between the heel 220 and the toe 222) on the removable body member 240 to retain the removable body member 240 to the main body member 230, as described above. Additionally, the connecting element 260 and the engagement surface 271 exert a vertical retaining force component (i.e. between the top 216 and the sole 218) on the removable body member 240 to retain the removable body member 240 to the main body member 230 in this embodiment. In other words, in this embodiment, the connecting structure between the main body member 230 and the removable body member 240, including the projections 252, 252', the notches 250, 250', the connecting element 260, and the engagement surface 271, exert retaining forces along all three dimensional axes to secure the removable body member 240 against movement. As also described above, the perimeter edges 243, 245 of the removable body member 240 and the main body member 230 engage each other to seal the juncture between the two members 230, 240 after the removable body member 240 is locked in place.

As described above with respect to the embodiment shown in FIGS. 1-7, it is understood that the projections 252, 252', the notches 250, 250', the connecting element 260, and the engagement surface 271 may exert other force components on the removable body member 240 in addition to the vertical, horizontal, and/or lateral retaining force components discussed above. In other embodiments, where the configuration (s) and/or orientation(s) of the main body member 230, the removable body member 240, and/or the connecting element 260 are different, the connections between these components and the forces exerted by these components may differ as well.

The removable body member 240 can be disconnected from the main body member 230 in a similar manner. The connecting element 260 in the locked position, as shown in FIG. 22, is manipulated to rotate the connecting element 260 to the unlocked position, as shown in FIG. 21, such as through use of the specialized tool 153. In this embodiment, the connecting element 260 is rotated approximately a half-turn (~180°) in the counterclockwise direction in FIGS. 21-22 to move from the locked position to the unlocked position. Once the connecting element 260 is unlocked, the removable body member 240 can be pulled away from the main body member 230.

Figure 23:
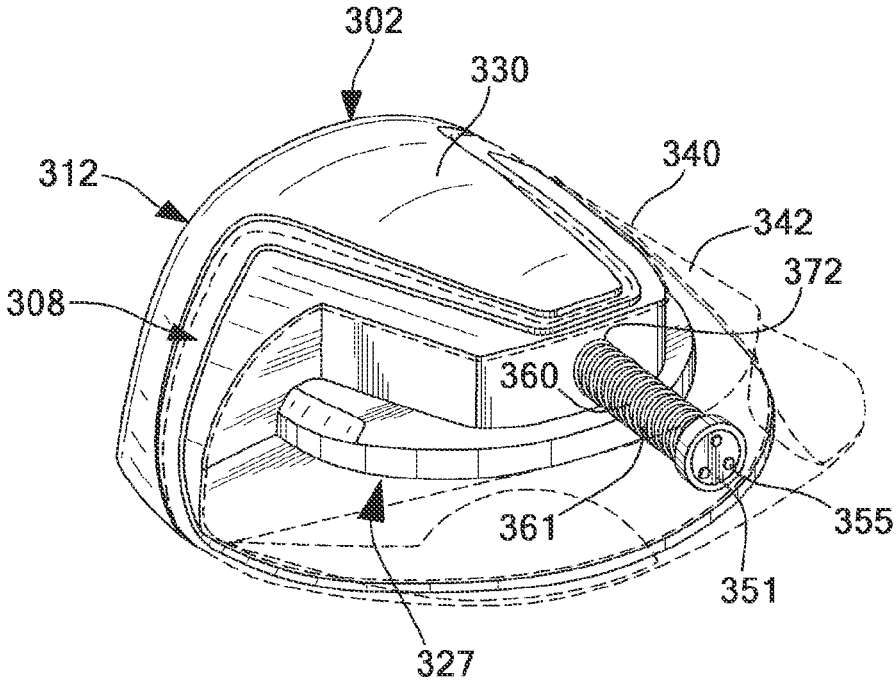
FIG. 23 is a bottom rear perspective view of a fourth illustrative embodiment of a head of a ball striking device according to the present invention, with a removable body member shown as transparent to show internal detail.

A third illustrative embodiment of a ball striking head 302 is shown in FIG. 23, and is described using the "3XX" series of reference numerals. Many of the features of this embodiment of the head 302 have been described above with respect to the heads 102, 202 shown in FIGS. 1-8 and 20-22, and duplicate descriptions of such features with respect to the head 302 may be abbreviated or eliminated, with similar reference numerals used to describe common features with the "3XX" series, rather than the "1XX" or "2XX" series of reference numerals.

The embodiment of the head 302 in FIG. 23 includes a face 312, a body 308 connected to the face 312, and a hosel (not shown), as described above. A main body member 330 and a removable and interchangeable body member 340 combine to form the body 308 of the head 302, as also described above. The main body member 330 and the removable body member 340 in FIG. 23 include some features that are different from those of the main body members 130, 230 and the removable body members 140, 240 described above with respect to FIGS. 1-8 and 20-22.

In the embodiment shown in FIG. 23, the removable body member 340 includes a frame member 342 and a connecting element 360 connected to the frame member 342 in the form of a screw or bolt 361. The connecting element 360 is movable to connect and disconnect the removable body member 340 to and from the main body member 330, through rotation of the screw 361 into and out of an opening 372 in the back end 327 of the main body member 330. The connecting element 360 in this embodiment also contains an engagement portion 351 configured similarly to the engagement portions 151, 251 of the connecting elements 160, 260 described above, having a plurality of holes 355 adapted for engagement by a specialized tool, such as the tool 153 shown in FIG. 8. The frame member 342 is complementarily shaped with the back end 327 of the main body member 330 to facilitate the connection between the removable body member 340 and the main body member 330. For example, as shown in FIG. 23, the back end 327 of the main body member 330 is generally convex, and the frame member 342 has a generally concave configuration, to fit around the back end 327 of the main body member 330. In this embodiment, the frame member 342 may also be regarded as being generally U-shaped, similarly to the frame members 142, 242 described above. The complementary shape of the frame member 342 and the main body member 330 may also include interlocking structures to further secure the removable body member 340 to the main body member 330, such as the interlocking projections 152, 252, 252' and notches 150, 250, 250' described above with respect to FIGS. 3-7 and 20-22. Other features of the main body members 130, 230 and the removable body members 140, 240 described above can be incorporated into the embodiment shown in FIG. 23.

In another embodiment (not shown), a head may include a connecting element having an orientation that is reversed or transposed with respect to the connecting elements 160, 260, 360 described above. In other words, the head may include a main body member with a moveable connecting element that is moveable between a locked position, where the connecting element engages an engagement surface on the removable body member, and an unlocked position, where the connecting element does not engage the engagement surface, and the removable body member can be disconnected from the main body member.

In a further embodiment (not shown), a head may be configured for attachment of two or more removable body members simultaneously to the main body member. In this embodiment, each removable body member may have a separate connecting element, and the main body member may have structure to engage each of the removable body members, such as mating engagement structure and structure for engagement by the connecting elements.

The removable body members 140, et seq. described above can be made from one or more of a variety of different materials, including metals, polymers, ceramics, composites, wood, or any other suitable material. In one embodiment, the removable body member 140, et seq. is made at least partially from a polymer, such as epoxy or urethane, or a polymer composite material, for example, a carbon/epoxy or carbon/urethane composite. In another embodiment, removable body member 140, et seq. can be made at least partially from a metal, including metal alloys and metal matrix composite materials. The material of the removable body member 140, et seq. can be selected based on desired properties and characteristics, such as weight/density, strength, durability, or other characteristics. The properties of the material of the removable body member 140, et seq. allows for customization of the removable body member 140, et seq. to achieve specified performance characteristics for the head 102, et seq. For example, the removable body member 140, et seq. may have a relatively high weight/density, which can add more weight to the head 102, et seq. and/or change the weight distribution (including COG and MOI). The removable body member 140, et seq. can be manufactured using any known technique, depending on the identity of the material of the removable body member 140, et seq., including the techniques described above, as well as any other suitable technique or combination of such techniques.

As described above, multiple different removable body members 140, et seq. having different properties and characteristics can be interchanged with the main body member 130, et seq. to customize the properties of the head 102, et seq. At least some of these different removable body members 140, et seq. may be made from different materials, lending different properties to the removable body members 140, et seq.

Figure 24:
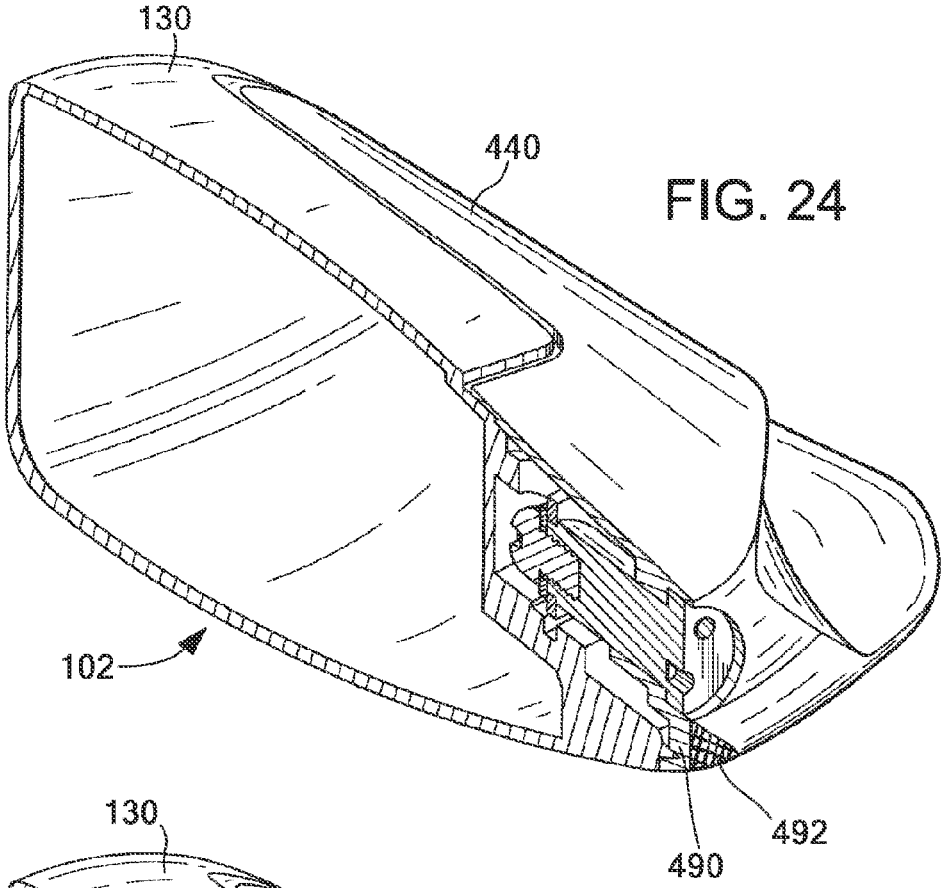
FIG. 24 is a cross-sectional view of a fifth embodiment of a head of a ball striking device according to the present invention.
Figure 25:
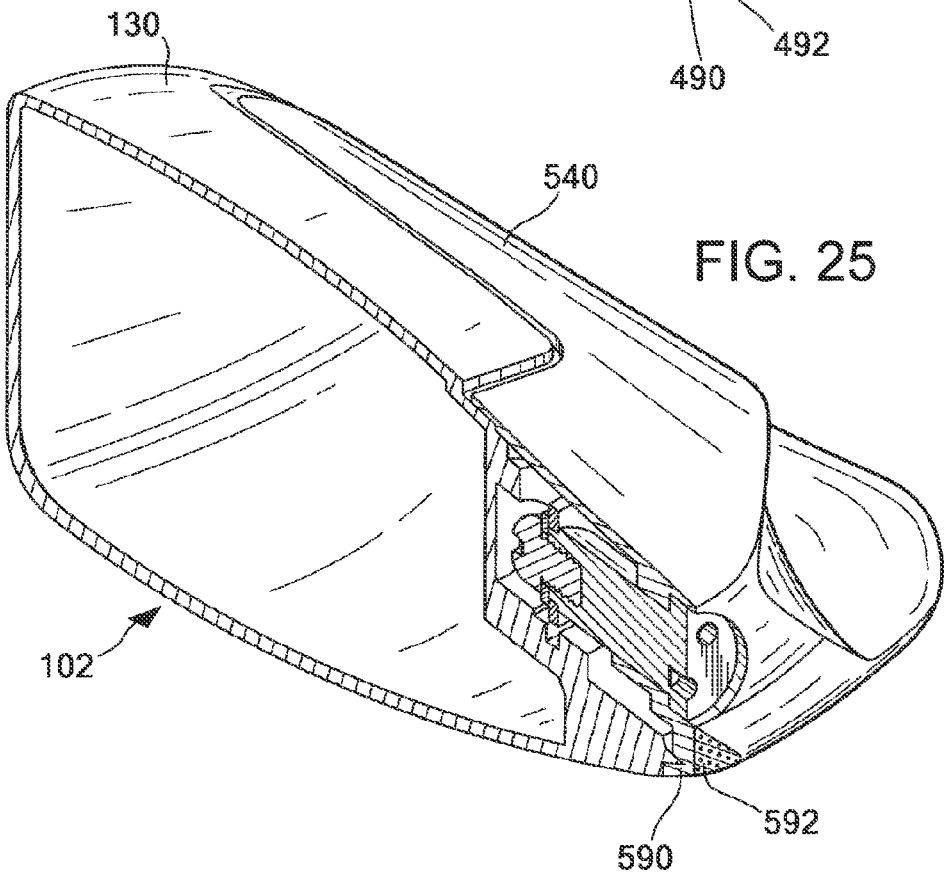
FIG. 25 is a cross-sectional view of a sixth embodiment of a head of a ball striking device according to the present invention.

In one embodiment, a removable body member 440, 540 may contain multiple materials 490, 492, 590, 592, as shown in FIGS. 24-25, which can provide for further customization of properties. The removable body members 440, 540 in FIGS. 24-25 are otherwise identical to the removable body member 140 in FIGS. 2-8, and are connected to the main body member 130 to form a head 102.

In the embodiment shown in FIG. 24, the removable body member 440 contains a first bulk material 490 and a second material 492, in the form of an insert 492, connected to the first material 490. In this embodiment, the materials 490, 492 are integrally joined together to form a single piece, but in other embodiments, the materials 490, 492 may be joined together in another manner. Additionally, in this embodiment, the insert material 492 has a higher density than the first material 490, and the insert 492 is arranged proximate the outer periphery of the removable body member 440, as also shown in FIG. 24. The greater weight of the insert 492 increases the moment of inertia of the head 102, by distributing more weight around the outer periphery of the head 102. The removable body member 440 can be manufactured using different techniques, depending on the identities of the two materials 490, 492. For example, a metal insert 492 can be placed in a mold and then the bulk material 490 can be infiltrated into the mold to form around the insert 492. As another example, the second material 492 can be injected into a mold in flowable form, and then the bulk material 490 can be injected into the mold after the second material 492 solidifies. Further suitable techniques can be used as desired.

In the embodiment shown in FIG. 25, the removable body member 540 contains a first bulk material 590 and a second material 592, in the form of a material with doping addition 592. In other words, the doped material 592 is a second material that is present within the bulk material 590, such as a soluble alloying addition, a composite filler, an interstitial phase, etc. Additionally, in this embodiment, the doped material 592 has a higher density than the first material 590, and the doped material 592 is arranged proximate the outer periphery of the removable body member 540, as also shown in FIG. 25. The greater weight of the doped material 592 increases the moment of inertia of the head 102, by distributing more weight around the outer periphery of the head 102. One example of a doping addition is tungsten powder, which can be added to a polymer bulk material such as urethane, to increase the density of the doped portion of the material. The removable body member 540 can be manufactured using different techniques, depending on the identities of the two materials 590, 592. For example, an insert of the doped material 592 can be placed in a mold and then the bulk material 590 can be infiltrated into the mold to form around the insert. As another example, the doped material 592 can be injected into a mold, and then the bulk material 590 can be injected into the mold after the second material 592 solidifies. Further suitable techniques can be used as desired.

The main body members 130, et seq. and removable body members 140, et seq. described herein and shown in FIGS. 1-25 are illustrated as part of a head 102, et seq. of a wood-type golf club 100 as shown in FIG. 1, but in other embodiments, other types of heads (such as an iron-type head or a putter head) may be constructed using at least some of the features described herein, which may have the same or similar configurations described herein. It is understood that these configurations may vary in other embodiments, and that features of any of the embodiments described above may be incorporated into any other embodiments.

The connecting elements 160, et seq. shown and described herein, as well as associated connecting structure, may be made of any suitable material that provides adequate performance, including any materials mentioned herein with respect to other components. In one embodiment, at least the connecting element 160, et seq. and associated mounting structure may be made using materials that are as light as practicable, in order to reduce the effect of the weight of the connecting element 160, et seq. on the weight of the entire head 102, et seq. In this configuration, the designer of the head 102, et seq. has more room to distribute weight in desirable places across the head 102, et seq. For example, in one embodiment, the connecting element 160, et seq. may be formed partially or entirely of a light metal or alloy, such as aluminum and aluminum alloys.

Club heads 102, et seq. incorporating the features disclosed herein may be used as a ball striking device or a part thereof. For example, a golf club 100 as shown in FIG. 1 may be manufactured by attaching a shaft or handle 104 to a head that is provided, such as the head 102, et seq. as described above. "Providing" the head, as used herein, refers broadly to making an article available or accessible for future actions to be performed on the article, and does not connote that the party providing the article has manufactured, produced, or supplied the article or that the party providing the article has ownership or control of the article. In other embodiments, different types of ball striking devices can be manufactured according to the principles described herein. Manufacturing the main body member 130, et seq. may include attachment of a backbody member to a face frame member, as described above. Additionally, the head 102, et seq., golf club 100, or other ball striking device may be fitted or customized for a person by connecting or interchanging a removable body member 140, et seq. to customize the weighting and/or other properties of the head 102, et seq. Such customization may include selecting a removable body member 140, et seq. with specific properties and connecting the removable body member 140, et seq. to the main body member 130, et seq. This customization may further include removing a previously-connected removable body member 140, et seq. and interchanging it with an alternate removable body member 140, et seq. having at least one different property or characteristic.

Heads 102, et seq. incorporating the removable body members 140, et seq. disclosed herein may be used as part of a kit or assembly that includes a head 102, et seq. as described above, along with one or more removable and/or interchangeable body members 140, et seq. configured for alternate and/or interchangeable connection to the head 102, et seq. If the kit includes multiple removable body members 140, et seq., each of them may have different properties, as described above. The kit may also include one or more shafts 104 for connection to the head 102, et seq.

The ball striking devices and heads therefor as described herein provide many benefits and advantages over existing products. For example, the properties of the head may be customized by attaching a particular removable body member to the head and/or interchanging an existing removable body member with a different removable body member. For example, the use of one or more different removable body members permits the mass/weight properties of the head to be adjusted, including the total weight, center of gravity, weight distribution, moment of inertia, etc. These properties, in turn, may affect the golfer's swing, the behavior of the ball upon impact, and other aspects of the use of the club. Other properties can be customized by use of different body members, including aesthetic appearance (which could include sponsorship/branding), aerodynamics, ground contact properties (friction, drag, etc.), sound, feel, etc. As another example, the connecting elements described herein allow for quick and easy connection and disconnection of the removable body member to and from the head, facilitating such customization. Further, the features of the heads described herein permit wider tolerances in design and manufacturing of the connected components, while still achieving reliable connections and satisfactory sealing between components. Still further benefits and advantages are recognized by those skilled in the art.

While the invention has been described with respect to specific examples including presently preferred modes of carrying out the invention, those skilled in the art will appreciate that there are numerous variations and permutations of the above described systems and methods. Thus, the spirit and scope of the invention should be construed broadly as set forth in the appended claims.

What is claimed is:

1. A wood-type golf club head comprising:

a face having a ball striking surface configured for striking a ball;

a main body member connected to the face and defining an internal volume between the face and the main body member, the main body member having a rear side opposite the face and a slot located in the rear side of the main body member, wherein an engagement surface is defined within the slot;

a removable body member removably connected to the main body member, the removable body member having a passage extending therethrough; and a connecting element removably connecting the removable body member to the main body member, the connecting element comprising a pin mounted within the passage in the removable body member such that the pin is rotatable within the passage about an axis of rotation extending from a rear of the head toward the face, the connecting element further comprising an engaging member connected to the pin and extending from the pin radially with respect to the axis of rotation such that the engaging member extends further from the axis of rotation than any other portion of the connecting member, wherein the connecting element is moveable by rotation of the pin between a locked position, where wherein at least a portion of the engaging member is received within the slot to engage the engagement surface to retain the removable body member to the main body member, and an unlocked position, where the engaging member is positioned outside the slot and does not engage the engagement surface and the removable body member is removable from the main body member.

2. The golf club head of claim 1, wherein the main body member has a plurality of notches located on the rear side, and the removable body member has a plurality of projections, each projection being received in a corresponding one of the notches to cooperate with the connecting element to retain the removable body member to the main body member.

3. The golf club head of claim 2, wherein each of the notches comprises an elongated channel extending generally in a direction from a front of the head to a rear of the head, and each of the projections comprises an elongated ridge cooperatively dimensioned to be received within a corresponding one of the elongated channels.

4. The golf club head of claim 3, wherein each of the channels has an open end proximate the rear of the main body member, and the removable body member is connected to the main body member by sliding the ridges into the open ends of the corresponding channels and sliding the removable body member generally in the direction of the channels toward the front of the head.

5. The golf club head of claim 2, wherein the engaging member engages the engagement surface to exert a horizontal retaining force on the removable body member and wherein the projections engage the notches to exert a vertical retaining force and a lateral retaining force on the removable body member to retain the removable body member to the main body member.

6. The golf club head of claim 1, wherein the pin has an axis of rotation extending generally perpendicular to the ball striking surface.

7. The golf club head of claim 1, wherein the engaging member comprises a plate extending radially from the axis of rotation of the pin.

8. The golf club head of claim 7, wherein the plate has a protrusion thereon, and wherein the main body member has a detent proximate the engagement surface that receives the protrusion in the locked position.

9. The golf club head of claim 7, wherein at least a portion of the plate is received within the slot to engage the engagement surface in the locked position.

10. The golf club head of claim 1, wherein the engagement surface has a ramp portion extending inward from an open end of the slot, and wherein the engaging member is configured to enter the open end of the slot to engage the ramp portion and slide across the ramp portion as the engaging member moves from the unlocked position to the locked position.

11. The golf club head of claim 10, wherein the ramp portion widens the open end of the slot such that a width of the slot tapers inwardly from the open end of the slot.

12. The golf club head of claim 1, wherein the main body member comprises a recessed perimeter area, and the removable body member has a perimeter flange extending around at least a portion of an outer periphery of the removable body member, and wherein the perimeter flange sits within the recessed perimeter area and forms a lap joint with the recessed perimeter area.

13. A golf club head comprising:

a face having a ball striking surface configured for striking a ball;

a main body member connected to the face and having a rear side opposite the face and a slot located in the rear side of the main body member, wherein an engagement surface is defined within the slot, the engagement surface haven a ramp portion extending inward from an open end of the slot, and wherein the ramp portion widens the open end of the slot such that a width of the slot tapers inwardly from the open end of the slot;

a removable body member removably connected to the main body member; and a connecting element removably connecting the removable body member to the main body member, the connecting element comprising a moveable engaging member, wherein the engaging member is moveable between a locked position, where at least a portion of the engaging member is received within the slot to engage the engagement surface to retain the removable body member to the main body member, and an unlocked position, where the engaging member does not engage the engagement surface and the removable body member is removable from the main body member, wherein the engaging member is configured to enter the open end of the slot to engage the ramp portion and slide across the ramp portion and into the slot as the engaging member moves from the unlocked position to the locked position.

14. The golf club head of claim 13, wherein the main body member has a plurality of notches, and the removable body member has a plurality of projections, each projection being received in a corresponding one of the notches to cooperate with the connecting element to retain the removable body member to the main body member.

15. The golf club head of claim 14, wherein each of the notches comprises an elongated channel extending generally in a direction from a front of the head to a rear of the head, and each of the projections comprises an elongated ridge cooperatively dimensioned to be received within a corresponding one of the elongated channels.

16. The golf club head of claim 13, wherein the connecting element comprises a pin rotatably mounted to the removable body member, the engaging member being connected to the pin, and wherein the connecting element is moveable by rotation of the pin between the locked position and the unlocked position.

17. A wood-type golf club head comprising:

a face having a ball striking surface configured for striking a ball;

a main body member connected to the face and defining an internal volume between the face and the main body member, the main body member having a rear side opposite the face and an engagement surface located in the rear side;

a removable body member removably connected to the main body member; and a connecting element removably connecting the removable body member to the main body member, the connecting element comprising a pin rotatably mounted to the removable body member and an engaging member connected to the pin, wherein the connecting element is moveable by rotation of the pin between a locked position, where the engaging member engages the engagement surface to retain the removable body member to the main body member, and an unlocked position, where the engaging member does not engage the engagement surface and the removable body member is removable from the main body member, wherein the main body member has a plurality of notches located on the rear side, and the removable body member has a plurality of projections, each projection being received in a corresponding one of the notches to cooperate with the connecting element to retain the removable body member to the main body member, and wherein each of the notches comprises an elongated channel extending generally in a direction from a front of the head to a rear of the head, and each of the projections comprises an elongated ridge cooperatively dimensioned to be received within a corresponding one of the elongated channels.

18. The golf club head of claim 17, wherein each of the channels has an open end proximate the rear of the main body member, and the removable body member is connected to the main body member by sliding the ridges into the open ends of the corresponding channels and sliding the removable body member generally in the direction of the channels toward the front of the head.

19. A wood-type golf club head comprising:

a face having a ball striking surface configured for striking a ball;

a main body member connected to the face and defining an internal volume between the face and the main body member, the main body member having a rear side opposite the face and an engagement surface located in the rear side;

a removable body member removably connected to the main body member; and a connecting element removably connecting the removable body member to the main body member, the connecting element comprising a pin rotatably mounted to the removable body member and an engaging member connected to the pin, wherein the connecting element is moveable by rotation of the pin between a locked position, where the engaging member engages the engagement surface to retain the removable body member to the main body member, and an unlocked position, where the engaging member does not engage the engagement surface and the removable body member is removable from the main body member, wherein the engaging member comprises a plate extending radially from an axis of rotation of the pin, and wherein the plate has a protrusion thereon, and wherein the main body member has a detent proximate the engagement surface that receives the protrusion in the locked position.

20. A golf club head comprising:

a face having a ball striking surface configured for striking a ball;

a main body member connected to the face and having a rear side opposite the face and an engagement surface located in the rear side;

a removable body member removably connected to the main body member; and a connecting element removably connecting the removable body member to the main body member, the connecting element comprising a moveable engaging member, wherein the engaging member is moveable between a locked position, where the engaging member engages the engagement surface to retain the removable body member to the main body member, and an unlocked position, where the engaging member does not engage the engagement surface and the removable body member is removable from the main body member, wherein the main body member has a plurality of notches, and the removable body member has a plurality of projections, each projection being received in a corresponding one of the notches to cooperate with the connecting element to retain the removable body member to the main body member, and wherein each of the notches comprises an elongated channel extending generally in a direction from a front of the head to a rear of the head, and each of the projections comprises an elongated ridge cooperatively dimensioned to be received within a corresponding one of the elongated channels.

* * * * *

UNITED STATES PATENT AND TRADEMARK OFFICE

CERTIFICATE OF CORRECTION

PATENT NO. : 8,435,135 B2
APPLICATION NO. : 12/790368
DATED : May 7, 2013
INVENTOR(S) : John T. Stites et al.

It is certified that error appears in the above-identified patent and that said Letters Patent is hereby corrected as shown below:

In the Claims:

Column 28, line 8, please replace “haven” with --having--

Signed and Sealed this
Twenty-fourth Day of September, 2013

Teresa Stanek Rea
*Deputy Director of the United States Patent and Trademark Office*